US009274451B2

(12) United States Patent
Itabashi et al.

(10) Patent No.: US 9,274,451 B2
(45) Date of Patent: Mar. 1, 2016

(54) IMAGE FORMING APPARATUS AND CARTRIDGE THEREFOR

(71) Applicant: Brother Kogyo Kabushiki Kaisha, Nagoya-shi, Aichi-ken (JP)

(72) Inventors: Nao Itabashi, Nagoya (JP); Naoya Kamimura, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/613,814

(22) Filed: Feb. 4, 2015

(65) Prior Publication Data

US 2015/0153675 A1 Jun. 4, 2015

Related U.S. Application Data

(62) Division of application No. 13/628,526, filed on Sep. 27, 2012, now Pat. No. 8,971,728.

(30) Foreign Application Priority Data

Sep. 29, 2011 (JP) ..... 2011-214625

(51) Int. Cl.
*G03G 15/06* (2006.01)
*G03G 21/18* (2006.01)

(52) U.S. Cl.
CPC ..... *G03G 15/065* (2013.01); *G03G 21/1867* (2013.01); *G03G 21/1892* (2013.01); *G03G 21/1896* (2013.01)

(58) Field of Classification Search
CPC ..... G03G 15/0836; G03G 15/0837; G03G 15/1821
See application file for complete search history.

(56) References Cited

U.S. PATENT DOCUMENTS 7,085,509 B2 8/2006 Kubota et al.
7,174,113 B2 2/2007 Kubota et al.

(Continued)

FOREIGN PATENT DOCUMENTS

CN 201464807 U 5/2010
EP 1542096 A1 6/2005

(Continued)

OTHER PUBLICATIONS

European Search Report issued in European Patent Application No. 12186091.0 mailed on Jan. 2, 2014.

(Continued)

*Primary Examiner* — Clayton E Laballe
*Assistant Examiner* — Victor Verbitsky
(74) *Attorney, Agent, or Firm* — Banner & Witcoff, Ltd.

(57) ABSTRACT

An image forming apparatus and a cartridge are provided. The image forming apparatus includes a main casing, a CPU as a judgment unit, and a main electrode. The cartridge accommodating a toner is attachable to and detachable from the main casing, and has a cartridge electrode electrically connectable to the main electrode. The CPU is configured to judge assembly or non-assembly of the cartridge with respect to the main casing and to judge whether or not the assembled cartridge is a new cartridge. The cartridge electrode is movable by a predetermined moving amount to permit the main electrode to be movable. As a result of a movement of the main electrode in accordance with the movement of the cartridge electrode, the CPU determines that the assembled cartridge is a new cartridge.

8 Claims, 14 Drawing Sheets

(56) References Cited

U.S. PATENT DOCUMENTS

| | | | | |
|---|---|---|---|---|
| 7,978,997 | B2 | 7/2011 | Tokuda | |
| 2005/0135832 | A1 | 6/2005 | Kubota et al. | |
| 2006/0110181 | A1 | 5/2006 | Kubota et al. | |
| 2007/0059018 | A1 * | 3/2007 | Tokuda | G03G 15/0806 399/90 |
| 2011/0211866 | A1 | 9/2011 | Hashimoto | |
| 2011/0243578 | A1 | 10/2011 | Ukai et al. | |
| 2011/0293294 | A1 | 12/2011 | Eto | |
| 2013/0084082 | A1 | 4/2013 | Itabashi et al. | |
| 2013/0084083 | A1 | 4/2013 | Itabashi et al. | |
| 2015/0147091 | A1 | 5/2015 | Itabashi et al. | |

FOREIGN PATENT DOCUMENTS

| | | | |
|---|---|---|---|
| JP | 11282324 | A * | 10/1999 |
| JP | 2007-079284 | A | 3/2007 |

OTHER PUBLICATIONS

European Search Report issued in European Patent Application No. 12186096.9 mailed on Jan. 2, 2014.

European Search Report issued in European Patent Application No. 12186071.2 mailed on Jan. 2, 2014.

Non-final Office Action received in corresponding U.S. Appl. No. 13/628,220 dated Mar. 5, 2014.

Non-Final Office Action received in corresponding U.S. Appl. No. 13/628,168 mailed May 27, 2014.

Oct. 14, 2014—(US) Notice of Allowance—U.S. Appl. No. 13/628,168.

Jul. 28, 2015—(US) Non-Final Office Action—U.S. Appl. No. 14/613,958.

* cited by examiner

SECOND CONFRONTING DIRECTION
FIRST CONFRONTING DIRECTION
106
108
107
104
105
103
107
108
R
101
UPSTREAM SIDE IN MOVING DIRECTION
DOWNSTREAM SIDE IN MOVING DIRECTION
LEFT (DOWNSTREAM SIDE IN SECOND CONFRONTING DIRECTION)
RIGHT (UPSTREAM SIDE IN SECOND CONFRONTING DIRECTION)

FIRST CONFRONTING DIRECTION
SECOND CONFRONTING DIRECTION
R
101
103
104
105
RIGHT
REAR
FRONT
LEFT
30(16)
55
351
109
102
109
110
110
45
38
34R(34)
35
31
36
46

IMAGE FORMING APPARATUS AND CARTRIDGE THEREFOR

CROSS REFERENCE TO RELATED APPLICATION

This application is a divisional application of prior U.S. application Ser. No. 13/628,526, filed Sep. 27, 2012, which claims priority from Japanese Patent Application No. 2011-214625 filed Sep. 29, 2011. The entire content of the priority application is incorporated herein by reference. The present application closely relates to a co-pending U.S. patent application Ser. No. 13/628,220, filed Sep. 27, 2012 (based on Japanese patent application No. 2011-214609 filed Sep. 29, 2011) and another co-pending U.S. patent application Ser. No. 13/628,168, filed Sep. 27, 2012 (based on Japanese patent application No. 2011-214655 filed Sep. 29, 2011) which are incorporated herein by reference.

TECHNICAL FIELD

The present invention relates to an electro-photographic type image forming apparatus, and to a cartridge to be used in the image forming apparatus.

BACKGROUND

As an electro-photographic type image forming apparatus, a printer including a photosensitive body and a developing cartridge configured to supply toner to the photosensitive body is known.

A conventional printer is provided with a detection device for detecting information of the developing cartridge assembled therein, for example, for detecting whether or not the cartridge is a brand new cartridge.

Japanese Patent Application Publication No. 2007-79284 discloses an integral detection structure having a detection projection and a feed electrode. The detection projection is made from an electrically conductive resin and is provided at a side surface of the developing cartridge. The projection is in abutment with an actuator in a main casing. The feed electrode is configured to abut on a feed electrode in the main casing.

The detection structure is covered by a gear cover, and is irreversibly displaceable from a new cartridge position to an old cartridge position. The detection projection and the feed electrode are accommodated in the gear cover in case of the new cartridge position, and these are exposed to an outside through an opening of the gear cover in case of the old cartridge position.

SUMMARY

According to the detection structure disclosed in the publication, the detection projection and the feed electrode are provided integrally with each other, and the detection projection is abutted on the actuator while the feed electrode is abutted on the feed electrode of the main casing at the old cartridge position.

Therefore, high positioning accuracy is required to satisfy both positioning of the detection projection relative to the actuator and another positioning of the feed electrode relative to the feed electrode of the main casing.

Accordingly, if the developing cartridge is not sufficiently accommodated in the printer, positioning accuracy between the detection projection and the actuator and between the feed electrode and the feed electrode of the main casing may be degraded. For example, there may be a case that the actuator is out of contact with the detection projection while the feed electrodes are in contact with each other. In the latter case, erroneous detection occurs that old cartridge is accommodated in spite of the accommodation of a brand new cartridge.

In view of the foregoing, it is an object of the present invention to provide an image forming apparatus and a cartridge to be accommodated therein, the image forming apparatus capable of accurately detecting a condition of the accommodated cartridge.

In order to attain the above and other objects, the present invention provides an image forming apparatus including: a main casing; a cartridge; a main electrode; and a judgment unit. The cartridge is configured to be attached to and detached from the main casing and to accommodate therein developing agent. The cartridge has a cartridge electrode configured to be moved in a moving direction by a predetermined moving amount. The main electrode is configured to be positioned in confrontation with the cartridge electrode in a confronting direction and electrically connectable to the cartridge electrode. The main electrode is configured to be moved in the confronting direction in accordance with a movement of the cartridge electrode. The judgment unit is configured to judge that a cartridge attached to the main casing is a new cartridge if the main electrode is moved in the confronting direction.

According to another aspect, the present invention provides a cartridge including: a cartridge frame; a drive input portion; and a cartridge electrode. The cartridge frame is configured to accommodate therein developing agent. The cartridge frame includes a first side wall and a second side wall spaced away therefrom and in confrontation therewith in a confronting direction. The drive input portion is provided at one of the first side wall and the second side wall and configured to receive an external driving force. The cartridge electrode is provided at the second side wall and configured to be moved in a moving direction by a predetermined moving amount in response to a reception of the external driving force into the cartridge electrode as a result of an input of the external driving force to the drive input portion. The cartridge electrode is also configured to receive an external electric power. The cartridge electrode includes a first region and a second region. The first region is a projection.

According to still another aspect, the present invention provides a cartridge including: a cartridge frame; a drive input portion; and a cartridge electrode. The cartridge frame has a developing agent accommodating portion configured to accommodate developing agent therein. The cartridge frame includes a first side wall and a second side wall spaced away therefrom and in confrontation therewith in a confronting direction. The drive input portion is disposed at a position opposite to the developing agent accommodating portion with respect to one of the first side wall and the second side wall and configured to receive an external driving force. The cartridge electrode is disposed at a position opposite to the developing agent accommodating portion with respect to the second side wall and configured to be moved in a moving direction by a predetermined moving amount in response to a reception of the external driving force into the cartridge electrode as a result of an input of the external driving force to the drive input portion. The cartridge electrode is also configured to receive an external electric power. The cartridge electrode includes a first region and a second region. The first region is a projection.

BRIEF DESCRIPTION OF THE DRAWINGS

In the drawings;

FIGS. 6A and 6B are partial perspective views of the developing cartridge for description of movement of the cartridge electrode in a new cartridge detecting operation; and in which FIG. 6A shows a state of a warm-up operation; and FIG. 6B shows a state after the warm-up operation;

FIGS. 7A and 7B are views for description of movement of a main electrode and an actuator in the new cartridge detecting operation; and in which FIG. 7A shows the state of the warm-up operation where the main electrode is at an advanced position and the actuator is at a light transmitting position, and FIG. 7B shows the state after the warm-up operation where the main electrode is at a retracted position and the actuator is at a light shielding position;

FIGS. 8A and 8B are partial perspective views of a developing cartridge according to a second embodiment of the present invention for description of movement of a cartridge electrode which is a component of the developing cartridge in a new cartridge detecting operation; and in which FIG. 8A shows a state prior to a warm-up operation and FIG. 8B shows a state after the warm-up operation;

FIGS. 10A and 10B are perspective views of a cartridge electrode which is a component of a developing cartridge according to a third embodiment of the present invention; and in which FIG. 10A is a perspective view as viewed from a right side and FIG. 10B is a perspective view as viewed from a left side;

FIGS. 10C-1 through 10C-3 are views for description of movement of the cartridge electrode in a new cartridge detecting operation according to the third embodiment, and in which FIG. 10C-1 shows a state prior to a warm-up operation where a main electrode is in confrontation with a first recessed region of a recessed portion of the cartridge electrode, FIG. 10C-2 shows a state of the warm-up operation where the main electrode is seated on a projection of the cartridge electrode, and FIG. 10C-3 shows a state after the warm-up operation where the main electrode is in confrontation with a second recessed region of the recessed portion of the cartridge electrode; and FIGS. 11A through 11C are views for description of movement of a main electrode and an actuator in the new cartridge detecting operation; and in which FIG. 11A shows a state prior to accommodation of the developing cartridge according to the third embodiment where the main electrode is at an advanced position and the actuator is at a first light transmitting position, FIG. 11B shows a state prior to a warm-up operation after accommodation of the developing cartridge where the main electrode is at a reference position and the actuator is at a light shielding position, and FIG. 11C shows a state of the warm-up operation where the main electrode is at a retracted position and the actuator is at a second light transmitting position;

FIGS. 12A and 12B are views particularly showing a cartridge electrode which is a component of a developing cartridge according to a fourth embodiment; and in which FIG. 12A is a perspective view of the cartridge electrode as viewed from a left side, and FIG. 12B is a perspective view for description of assembly of the cartridge electrode to a bearing member which is a component of the developing cartridge; and FIGS. 13A and 13B are views for description of movement of the cartridge electrode, a main electrode and an actuator in a new cartridge detecting operation; and in which FIG. 13A shows a state after a warm-up operation where the cartridge electrode is at a second position, the main cartridge is at a reference position and the actuator is at a light shielding position, and FIG. 13B shows a state of the warm-up operation where the cartridge electrode is at a first position, the main electrode is at a retracted position and the actuator is at a second light transmitting position.

DETAILED DESCRIPTION

A color printer as an image forming apparatus according to a first embodiment of the present invention will be described with reference to FIGS. 1 through 7B. Throughout the specification, the terms "upward", "downward", "upper", "lower", "above", "below", "beneath", "right", "left", "front", "rear" and the like will be used assuming that the image forming apparatus is disposed in an orientation in which it is intended to be used. More specifically, in FIG. 1 a left side and a right side are a front side and a rear side, respectively.

1. Overall Structure of Color Printer

Figure 1:
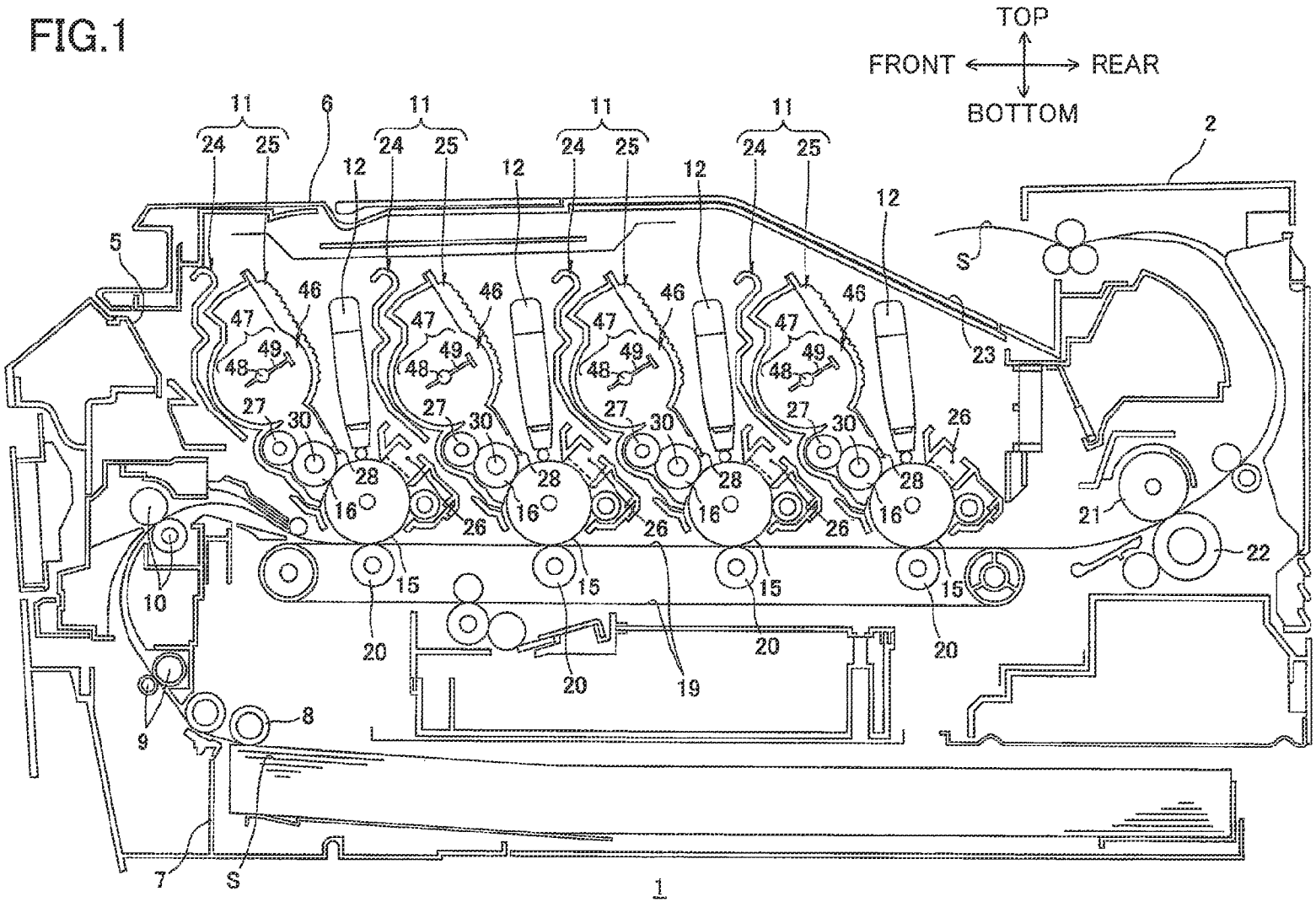
FIG. 1 is a cross-sectional view of a printer according to a first embodiment of the present invention.

Referring to FIG. 1, the printer 1 is a horizontal direct tandem type color printer. The printer 1 includes a main casing 2 having a generally box shape. The main casing 2 has an upper portion provided with a top cover 6 which can be opened or closed for opening and closing an opening 5. The top cover 6 has a rear end portion pivotally movably supported to the main casing 2. The printer 1 includes four process cartridges 11 corresponding to colors different from each other.

Each process cartridge 11 is detachable and attachable relative to the main casing 2. When mounted, the process cartridges 11 are juxtaposedly arrayed in the front-to-rear direction within the main casing 2. Each process cartridge 11 includes a drum cartridge 24 and a developing cartridge 25 detachable from and attachable to the drum cartridge 24.

Each drum cartridge 24 has a photosensitive drum 15. The photosensitive drum 15 is cylindrical in shape and extends in a lateral direction (rightward/leftward direction), and is rotatably supported to a frame of the drum cartridge 24.

The developing cartridge 25 has a developing roller 16 which has a developing roller shaft 30 extending in the lateral direction and made from metal. The developing roller 16 has a rear side exposed to an outside through a rear end portion of a frame of the developing cartridge 25. The developing roller 16 is positioned diagonally above and frontward of the photosensitive drum 15 and in contact therewith.

The developing cartridge 25 is provided with a supply roller 27, a layer thickness regulation blade 28, a toner chamber 46, and an agitator 47. The supply roller 27 is adapted to supply toner to the developing roller 16. The layer thickness regulation blade 28 is adapted to regulate a thickness of a toner layer supplied to the developing roller 16. The toner chamber 46 is positioned above the supply roller 27 and the layer thickness regulation blade 28, and the agitator 47 is provided in the toner chamber 46 for agitating the toner. The agitator 47 includes an agitation shaft 48 extending in the lateral direction and agitation blades 49 extending radially outwardly from the agitation shaft 48.

Toner accommodated in the toner chamber 46 is subjected to tribo-electric charging to have a positive polarity between the supply roller 27 and the developing roller 16. The toner is carried on an outer peripheral surface of the developing roller 16 in a form of a thin toner layer having a uniform thickness by the layer thickness regulation blade 28.

A scorotron charger 26 and an LED unit 12 are provided in confrontation with each photosensitive drum 15. After an outer peripheral surface of the photosensitive drum 15 is uniformly charged by the scorotron charger 26, the surface is exposed to light by the LED unit 12 based on a predetermined image data to form an electrostatic latent image on the surface. Then, a visible toner image (developing agent image) corresponding to the electrostatic latent image is formed on the outer peripheral surface of the photosensitive drum 15 by supplying toner carried on the developing roller 16 to the corresponding photosensitive drum 15.

A sheet cassette 7 is provided at a bottom portion of the main casing 2 for accommodating sheets S therein in a stacked state. Each sheet S accommodated in the sheet cassette 7 is passed through a U-shaped passage and is conveyed to a position between the photosensitive drum 15 and a conveyor belt 19 at a prescribed timing by a pickup roller 8, a sheet supply roller 9 and a pair of registration rollers 10. Then, each sheet S is conveyed rearward by the conveyer belt 19 at a position between each photosensitive drum 15 and each transfer roller 20. The toner image formed on the outer peripheral surface of each photosensitive drum 15 is sequentially transferred and superimposed onto the sheet S, thereby providing a color image on the sheet S.

The sheet S on which the color image has been formed is then conveyed to a fixing unit provided downstream of the conveyer belt 19. The fixing unit includes a heat roller 21 and a pressure roller 22. The color image is thermally fixed to the sheet S when the sheet S passes through the heat roller 21 and the pressure roller 22. The sheet S carrying the color image is then conveyed through an U-shaped passage frontward and upward, and is discharged onto a discharge tray 23 provided at the top cover 6.

2. Details of Developing Cartridge

Figure 2:
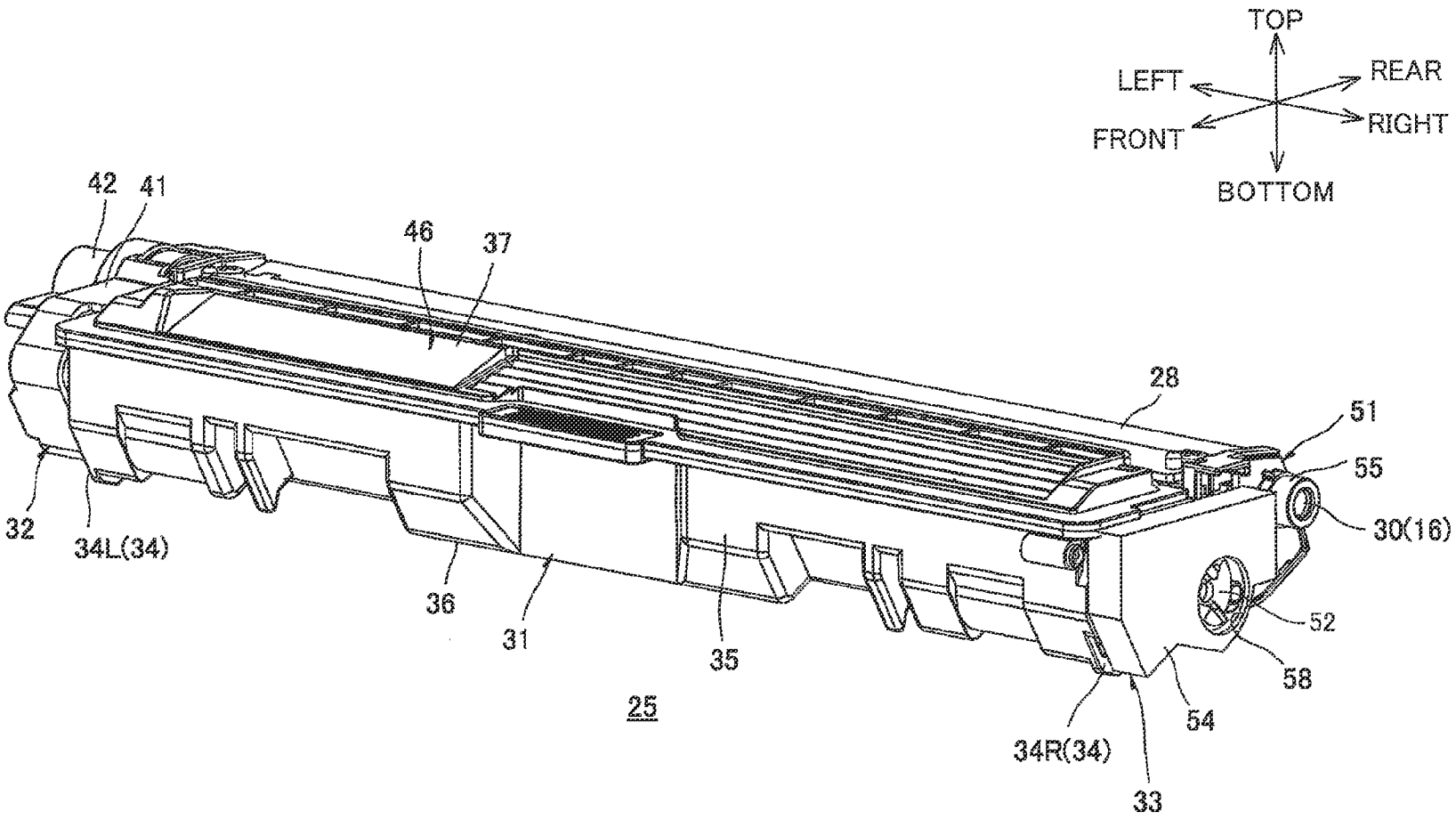
FIG. 2 is a perspective view of a developing cartridge accommodated in the printer shown in FIG. 1 as viewed from a diagonally front right side.
Figure 3:
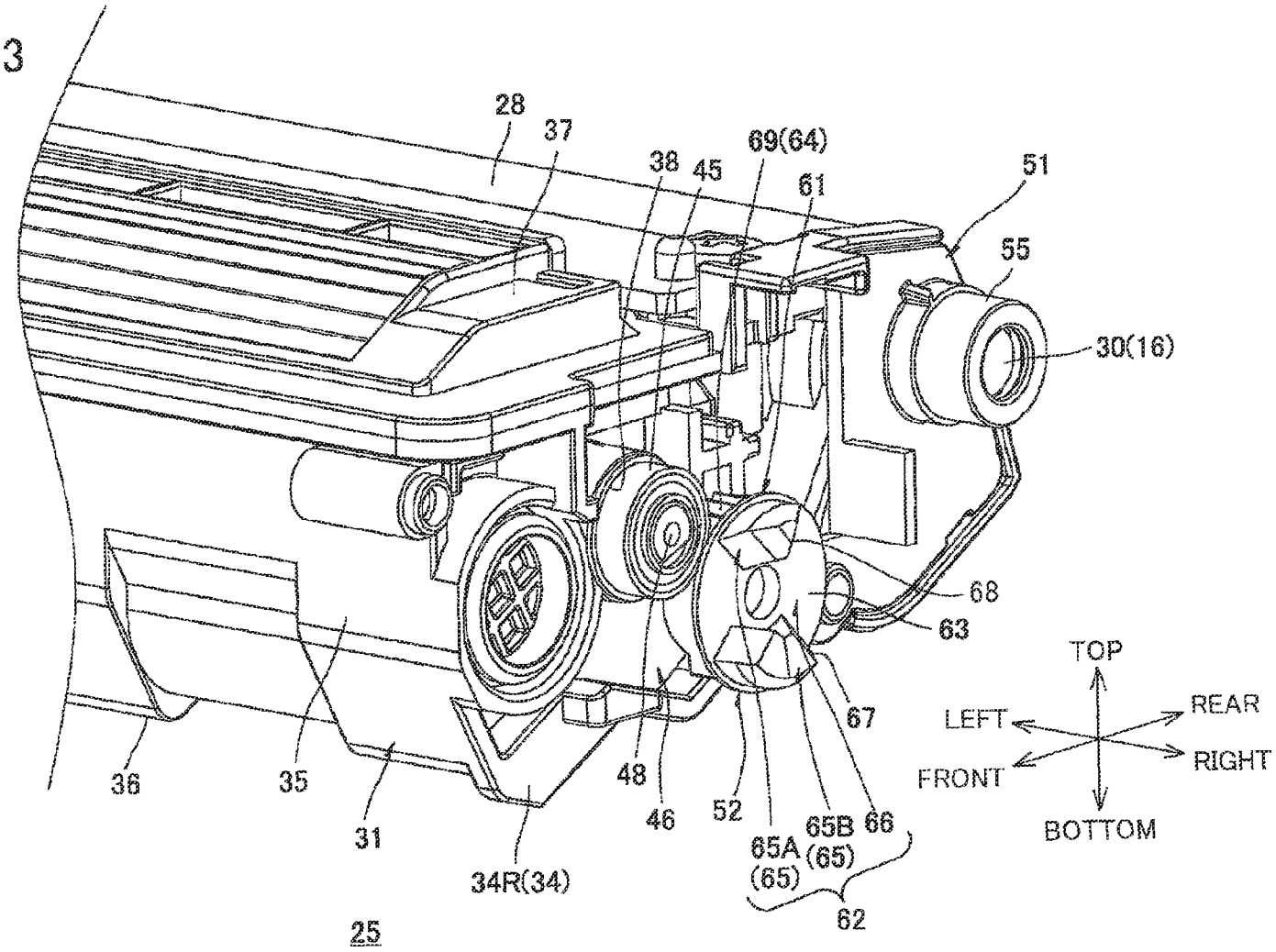
FIG. 3 is a partial perspective view of the developing cartridge of FIG. 2 as viewed from a diagonally front right side and without a power supply side cover.

As shown in FIGS. 2 and 3, the developing cartridge 25 includes a cartridge frame 31, a drive unit 32 positioned at a left side of the cartridge frame 31, and a power supply unit 33 positioned at a right side of the cartridge frame 31. The drive unit 32 may be positioned at a right side of the cartridge frame 31.

Throughout the description of the developing cartridge 25, regarding "direction", a side at which the developing roller 16 is positioned will be referred to as a "rear side" of the developing cartridge 25, and a side at which the thickness regulation blade 28 is positioned will be referred to as an "upper side" of the developing cartridge 25. That is, a "frontward/rearward direction" with respect to the developing cartridge 25 is different from the "frontward/rearward direction" with respect to the printer 1. More specifically, the developing cartridge 25 is assembled to the drum cartridge 24 and to the printer 1 such that the rear side and the front side of the developing cartridge 25 will correspond to a "lower rear side" and an "upper front side" of the printer 1.

(1) Cartridge Frame

The cartridge frame 31 extends in the lateral direction (confronting direction) and is generally box shaped. The cartridge frame 31 includes a pair of side walls 34, a front wall 35, a lower wall 36 and an upper wall 37. The pair of side walls 34 includes a left side wall 34L and a right side wall 34R.

Each side wall 34 extends in the frontward/rearward direction and in the vertical direction, and is generally rectangular shaped in a side view. The pair of side walls 34 is spaced away from each other in the lateral direction, and each side wall 34 is formed with an agitator shaft exposure hole 38 that exposes the agitation shaft 48 to the outside.

The exposure hole 38 is positioned at a generally center portion of the side wall 34 in the frontward/rearward direction and is generally circular shaped in a side view. The exposure hole 38 is penetrated through a thickness of the side wall 34 and has a diameter greater than an outer diameter of each lateral end portion of the agitation shaft 48. Each lateral end portion of the agitation shaft 48 extends through the exposure hole 38 and protrudes laterally outward from the side wall 34. An agitator gear 45 is fixedly (non-rotatably) coupled to each lateral end portion of the agitator shaft 48.

The front wall 35 extends in the lateral direction and is spanned between front end portions of the side walls 34. The lower wall 36 extends in the lateral direction and is spanned between lower end portions of the side walls 34 such that the lower wall 36 is connected to a lower end portion of the front wall 35. The upper wall 37 extends in the lateral direction and is spanned between upper end portions of the side walls 34 such that the upper wall 37 is connected to an upper end portion of the front wall 35. The upper wall 37 has a rear end portion at which the layer thickness regulation blade 28 is positioned such that the layer thickness regulation blade 28 is in contact with the developing roller 16 from above.

(2) Drive Unit

As shown in FIG. 2, the drive unit 32 includes a drive side cover 41 which extends in the lateral direction with its leftmost end being closed. The drive side cover 41 is hollow prismatic body shaped, and is provided with a collar portion 42. The collar portion 42 is positioned at a generally center portion of the drive side cover 41 in the frontward/rearward direction, and protrudes leftward therefrom. The collar portion 42 is generally hollow cylindrical shaped with its right end portion being in communication with an internal space of the drive side cover 41.

A generally cylindrical developing coupling (not shown) extending in the lateral direction is positioned within and supported to the collar portion 42 such that the developing coupling is rotatable relative to the collar portion 42. The developing coupling has a left end portion exposed to the outside from a left end portion of the collar portion 42. The left end portion of the developing coupling is fitted with a main coupling (not shown) provided to the main casing 2 such that relative rotation therebetween is prevented. A driving force from the main casing 2 is transmitted to the developing coupling through the main coupling. Further, the driving force is transmitted, through a gear train (not shown), to the developing roller shaft 30, a shaft of the supply roller 27, and the agitator shaft 48.

(3) Power Supply Unit

As shown in FIGS. 2 and 3, the power supply unit 33 includes a bearing member 51, a cartridge electrode 52, and a power supply side cover 54.

(3-1) Bearing Member

Figure 4:
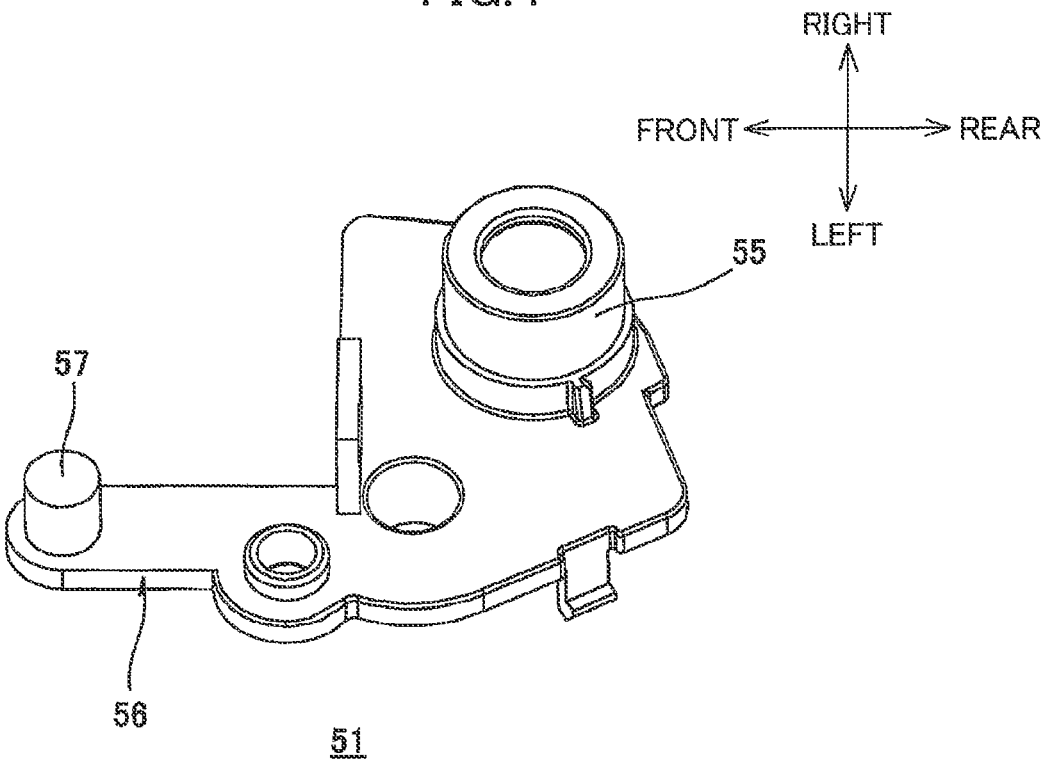
FIG. 4 is a perspective view of a bearing member which is a component of the developing cartridge of FIG. 3 as viewed from a right side.

The bearing member 51 is assembled to a right side of the right side wall 34R at the rear end portion of the developing cartridge 25. The bearing member 51 is made from an electrically conductive resin, and is generally rectangular plate shaped in a side view. As shown in FIG. 4, the bearing member 51 includes a developing roller shaft support portion 55 and an electrode support portion 56.

The developing roller shaft support portion 55 is positioned at a rear end portion of the bearing member 51 and is generally hollow cylindrical shaped extending rightward from a right side surface of the bearing member 51. The developing roller shaft support portion 55 has an inner diameter approximately equal to or greater than an outer diameter of a right end portion of the developing roller shaft 30. Further, the bearing member 51 is formed with an opening (not shown) coaxial with the developing roller shaft support portion 55 and having a diameter equal to the inner diameter of the developing roller shaft support portion 55. The right end portion of the developing roller shaft 30 extends through and is rotatably supported to the developing roller shaft support portion 55.

The electrode support portion 56 extends frontward from a lower front end portion of the bearing member 51, and is generally lever shaped. The electrode support portion 56 has a front end portion provided with a support boss 57 adapted to support the cartridge electrode 52. The support boss 57 protrudes rightward from a right side surface of the electrode support portion 56, and is generally cylindrical shaped.

(3-2) Cartridge Electrode

Figure 5A:
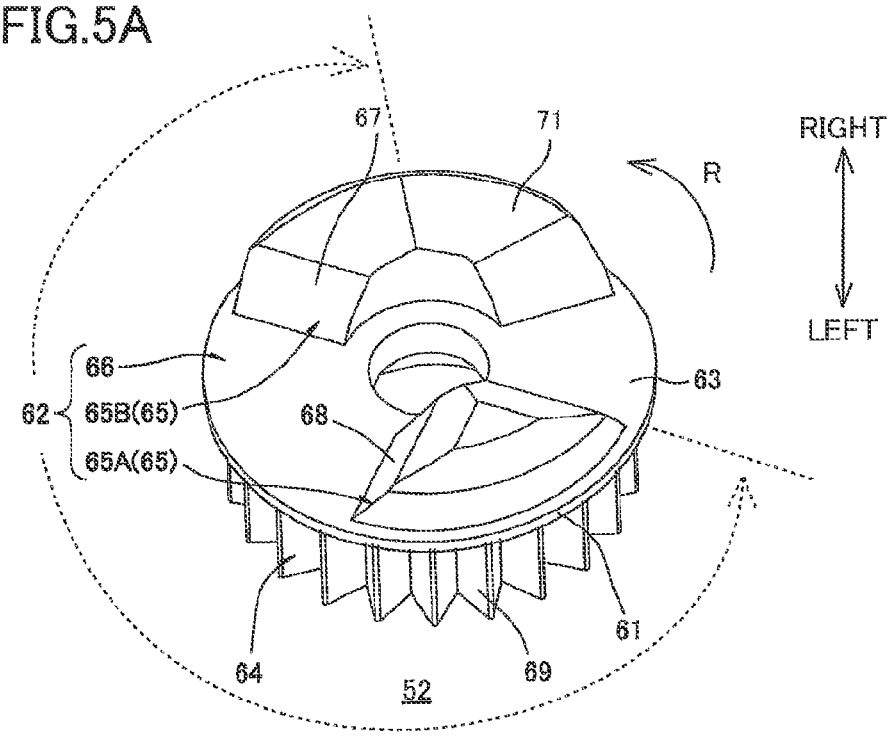
FIG. 5A is a perspective view of a cartridge electrode which is a component of the developing cartridge of FIG. 3 as viewed from a right side.
Figure 5B:
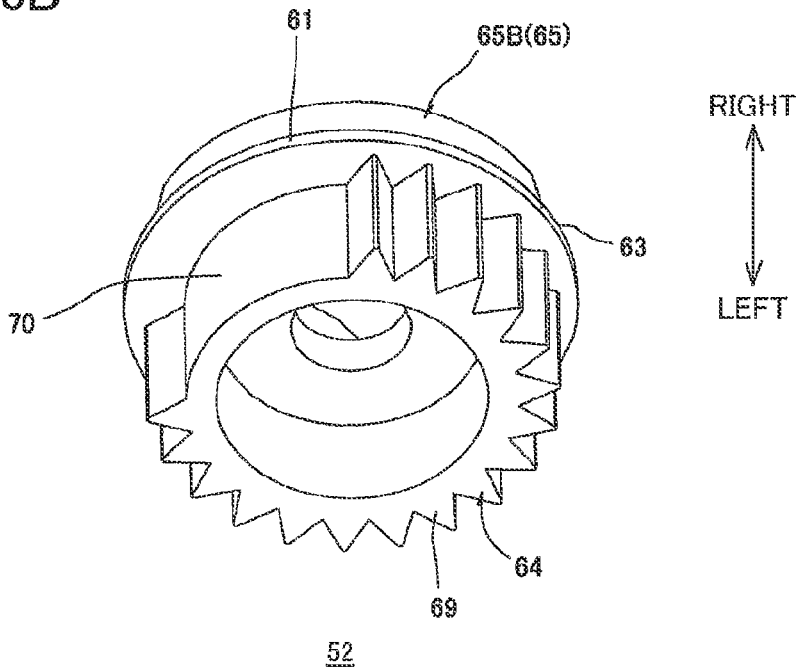
FIG. 5B is a perspective view of the cartridge electrode as viewed from a left side.

The cartridge electrode 52 is adapted to be electrically connected to a main electrode 81 (FIGS. 7A, 7B, described later) at a side of the main casing 2. As shown in FIG. 3, the cartridge electrode 52 is positioned frontward of the bearing member 51, and is made from an electrically conductive resin. As shown in FIGS. 5A and 5B, the cartridge electrode 52 integrally includes a base portion 61, a displacement portion 62, and a chipped gear 64 (gear teeth is partly lacking).

The base portion 61 has a thickness in the lateral direction and is generally circular disc shaped whose center portion is formed with a through-hole. The displacement portion 62 includes two projections 65 (65A, 65B) and a single recessed portion 66, those arrayed in a circumferential direction of the base portion 61 about a center axis thereof with a center angle of 270 degrees, as indicated by a dotted line in FIG. 5A.

The two projections 65 are angularly spaced away from each other by 180 degrees. Each projection 65 protrudes rightward from a right side surface 63 of the base portion 61 and is sector shaped in a side view whose center angle is 90 degrees. In the following description, assuming that the cartridge electrode 52 and the main electrode 81 are in confrontation with each other in the lateral direction. One of the projections 65 positioned at a downstream side in a counterclockwise direction in a right side view will be referred to as a first projection 65A, and remaining one of the projections 65 positioned at an upstream side in the counterclockwise direction in a right side view will be referred to as a second projection 65B.

Further, as shown in FIG. 5A, an ensuring portion 71 is provided at the cartridge electrode 52 at a position immediately upstream of the second projection 65B in the counterclockwise direction in a right side view. The ensuring portion 71 is sector-shaped and protrudes rightward from a right side surface 63 of the base portion 61. The ensuring portion 71 is in flush with the second projection 65B.

The recessed portion 66 is positioned between the projections 65A and 65B, and has a sector shape whose center angle is 90 degrees defined by the right side surface 63 of the base portion 61 and the projections 65A, 65B. That is, the recessed portion 66 is recessed leftward from the projections 65. More specifically, the recessed portion 66 is defined by a first end face 67 and a second end face 68. The first end face 67 is positioned upstream of the second end face 68 in the counterclockwise direction in a right side view. The first end face 67 is inclined diagonally rightward in a direction from the downstream end to the upstream end of the first end face 67, and the second end face 68 is inclined diagonally leftward in a direction from the downstream end to the upstream end of the second end face 68 in the counterclockwise direction in a right side view.

The chipped gear 64 is generally cylindrical shaped extending leftward from a left side surface of the base portion 61. The chipped gear 64 is concentric with the base portion 61. Gear teeth are provided at least at a position corresponding to the displacement portion 62 such that an array of the gear teeth along a circumferential direction of the base portion 61 has a center angle of 270 degrees. More specifically, a most upstream side tooth of the array of the gear teeth in the counterclockwise direction in a right side view is positioned below the most upstream side of the displacement portion 62, and a most downstream side tooth of the array of the gear teeth in the counterclockwise direction in a right side view is positioned below the most downstream side of the displacement portion 62. Incidentally, in the chipped gear 64, a portion where teeth are provided will be referred to as a toothed portion 69, and a portion where teeth are not provided will be referred to as a toothless portion 70.

The cartridge electrode 52 is supported to the support boss 57 and is rotatable about an axis of the support boss 57 in a counterclockwise direction, indicated as a rotation direction R in FIG. 5A. In a state where the developing cartridge 25 is a new cartridge (not in use), the chipped gear 64 is in meshing engagement with the agitator gear 45 from behind at the downstream end portion of the toothed portion 69 in the counterclockwise direction in a right side view. In this case, the first projection 65A is positioned at an upper end portion of the cartridge electrode 52.

(3-3) Power Supply Side Cover

As shown in FIG. 2, the power supply side cover 54 is generally rectangular shaped in a side view, whose right end portion is closed. The power supply side cover 54 is adapted to cover the right end portion of the developing cartridge 25 so as to cover the cartridge electrode 52. The power supply side cover 54 is formed with an opening 58 for exposing the cartridge electrode 52 to the outside.

The opening 58 is positioned at a lower portion and an intermediate portion in the frontward/rearward direction in the power supply side cover 54, and has a generally circular shape in a side view. The cartridge electrode 52 is exposed to the outside through the opening 58.

3. Main Casing

Figure 7A:
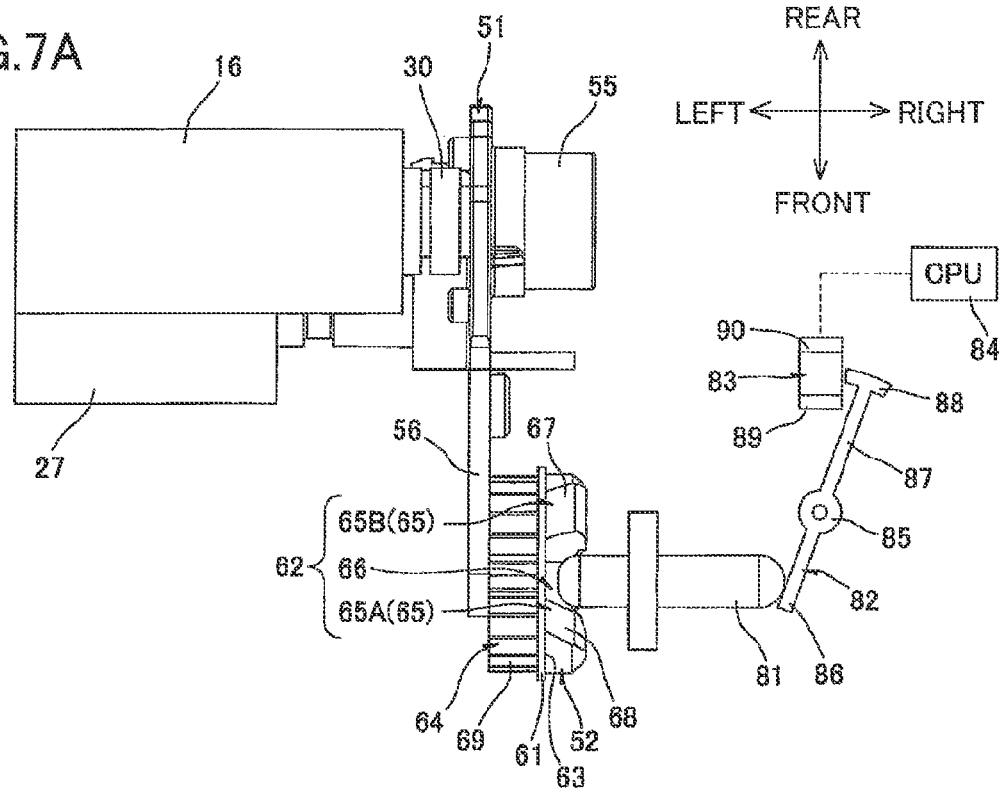
Figure 7B:
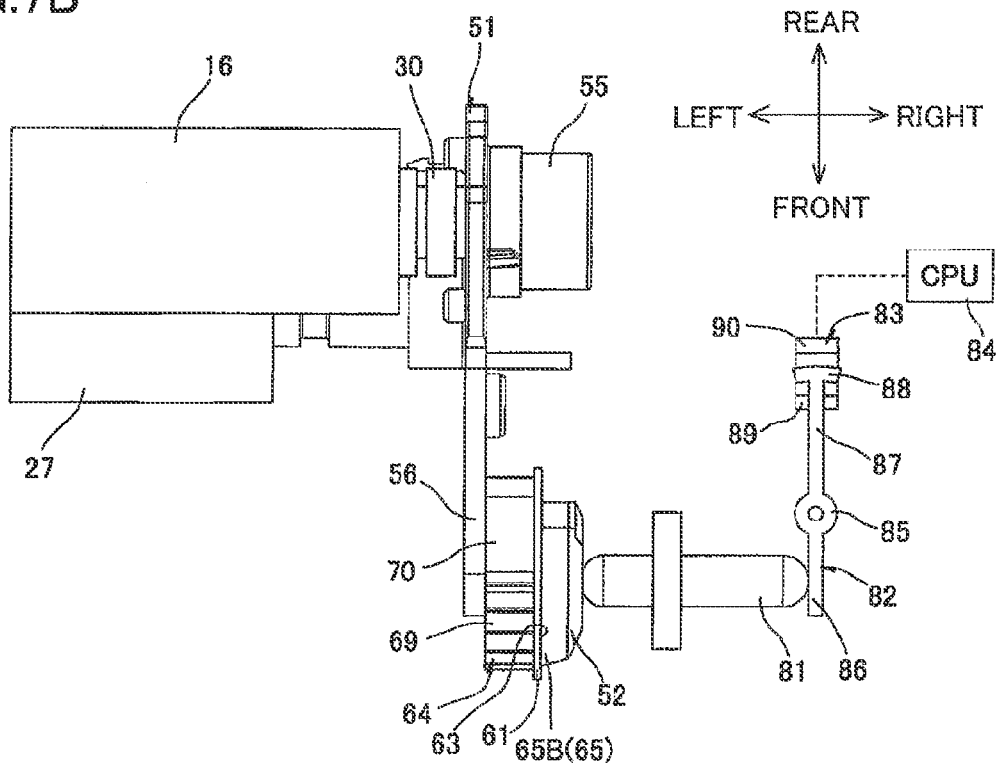

As shown in FIGS. 7A and 7B, the main electrode 81, an actuator 82, a photo-sensor 83 and a CPU 84 are provided within the main casing 2.

The main electrode 81 is positioned adjacent to the right side of the developing cartridge 25 when the developing cartridge 25 is mounted in the main casing 2. The main electrode 81 is made from metal. The main electrode 81 extends in the lateral direction and is generally cylindrical shaped. The main electrode 81 is supported to the main casing 2 and is slidably movable in the lateral direction between a retracted position as shown in FIG. 7B and an advanced position as shown in FIG. 7A. The advanced position is advanced leftward, and the retracted position is moved rightward from the advanced position. The main electrode 81 is electrically connected to a power source (not shown) in the main casing 2.

The actuator 82 integrally includes a pivot shaft 85, an abutment lever 86 and a light shielding lever 87. The pivot shaft 85 extends in the vertical direction and is generally hollow cylindrical shaped. The abutment lever 86 extends frontward from the pivot shaft 85. The light shielding lever 87 extends rearward from the pivot shaft 85. The light shielding lever 87 has a rear end portion provided with a light shielding plate 88 extending downward therefrom.

The actuator 82 is pivotally movably supported to the main casing 2 at a position adjacent to the right side of the developing cartridge 25 such that the abutment lever 86 is pivotally movable about the pivot shaft 85 so that the abutment lever 86 can be contacted with the right end of the main electrode 81.

More specifically, the actuator 82 is pivotally movable to a light transmitting position as shown in FIG. 7A where the abutment lever 86 is directed diagonally frontward and leftward and the light shielding lever 87 is directed diagonally rightward and rearward and to a light shielding position as shown in FIG. 7B where the abutment lever 86 and the light shielding lever 87 are directed in the frontward/rearward direction. The actuator 82 is connected to an urging member (not shown) such as a spring so that the actuator 82 is normally urged to the light transmitting position (so that the actuator 82 is urged clockwise in a plan view).

The photo-sensor 83 includes a light emitting element 89 and a light receiving element 90. The light emitting element 89 is adapted to emit detection light. The light receiving element 90 is adapted to receive the detection light and positioned spaced away from and rearward of the light emitting element 89. The photo-sensor 83 is positioned at the rear side of the actuator 82 such that the light shielding plate 88 of the actuator 82 in the light shielding position is positioned between the light emitting element 89 and the light receiving element 90. A combination of the photo-sensor 83 and the actuator 82 constitutes a detection unit.

In the light shielding position of the actuator 82 (FIG. 7B), the light shielding plate 88 is positioned between the light emitting element 89 and the light receiving element 90, so that the detection light emitted from the light emitting element 89 is blocked by the light shielding plate 88. On the other hand, in the light transmitting position of the actuator 82 (FIG. 7A), the light shielding plate 88 is retracted rightward away from a gap between the light emitting element 89 and the light receiving element 90. Thus, the detection light emitted from the light emitting element 89 is received by the light receiving element 90, whereupon an ON signal is transmitted from the photo-sensor 83. The CPU 84 is provided in the main casing 2 and is electrically connected to the photo-sensor 83 so as to receive an ON signal from the photo-sensor 83.

4. Operation for Detecting New Developing Cartridge

An operation for detecting a new developing cartridge 25 will be described. When the process cartridge 11 (the developing cartridge 25) is not assembled to the main casing 2, the actuator 82 is at the light transmitting position by the urging force of the urging member (not shown). Thus, the main electrode 81 is at the advanced position. In this case, the photo-sensor 83 transmits an ON signal to the CPU 84.

Upon receipt of the ON signal from the photo-sensor 83, the CPU 84 determines that the main electrode 81 is at the advanced position. Then, if this state continues for a predetermined time period (if the advanced position of the main electrode 81 is maintained for the predetermined time period), in other words, if the ON signal from the photo-sensor 83 is not interrupted within the predetermined time period, the CPU 84 determines that the developing cartridge 25 is not assembled to the main casing 2.

Then, the top cover 6 of the main casing 2 is opened to insert, from diagonally above and frontward into the main casing 2, the process cartridge 11 to which a new developing cartridge 25 is assembled. Then, the first projection 65A of the cartridge electrode 52 is brought into contact with the left end portion of the main electrode 81.

Then, the main electrode 81 is pushed rightward to the retracted position from the advanced position against the urging force of the urging member (not shown) applied to the actuator 82, so that the actuator 82 is pivotally moved in the counterclockwise direction in a plan view to the light shielding position from the light transmitting position.

Thus, output of the ON signal from the photo-sensor 83 to the CPU 84 is interrupted. That is, the detection unit (the actuator 82 and the photo-sensor 83) detects the retracted position of the main electrode 81.

Then, the CPU 84 determines that the main electrode 81 has been moved from the advanced position to the retracted position due to interruption of the ON signal from the photo-sensor 83.

After assembly of the developing cartridge 25 into the main casing 2, the main coupling (not shown) in the main casing 2 is fitted with the developing coupling (not shown) of the developing unit 32, preventing relative rotation therebetween. Thus, a driving force from the main casing 2 is transmitted to the developing coupling through the main coupling for starting a warm-up operation.

Then, a driving force from the developing coupling is transmitted to the agitator shaft 48 through the gear train (not shown) to rotate the agitator 47. As a result of rotation of the agitator 47, as shown in FIG. 3, a driving force from the agitator shaft 48 is transmitted to the toothed portion 69 of the chipped gear 64 through the agitator gear 45, so that the cartridge electrode 52 is rotated in the counterclockwise direction in a right side view.

Accordingly, as shown in FIG. 7A, the cartridge electrode 52 is moved relative to the main electrode 81 such that the left end portion of the main electrode 81 which has been seated on the first projection 65A confronts the recessed portion 66. In other words, the main electrode 81 can be moved leftward by a distance corresponding to a depth of the recessed portion 66.

Then, the main electrode 81 is pushed leftward by the urging force of the urging member (not shown) applied to the actuator 82, so that the main electrode 81 is moved to the advanced position while the left end portion of the main electrode 81 is moved along the inclined surface of the second end face 68. Simultaneously, the actuator 82 is pivotally moved in the clockwise direction in a plan view by the urging force of the urging member, so that the actuator 82 is moved to the light transmitting position from the light shielding position.

Thus, the photo-sensor 83 outputs an ON signal to the CPU 84. That is, the detection unit (the actuator 82 and the photo-sensor 83) detects the advanced position of the main electrode 81.

Then, the CPU 84 determines that the main electrode 81 has been moved from the retracted position to the advanced position upon receipt of the ON signal from the photo-sensor 83.

As a result of further rotation of the cartridge electrode 52 in the counterclockwise direction in a right side view, the main electrode 81 is relatively moved in the clockwise direction in a right side view from the recessed portion 66. Then, the left end portion of the main electrode 81 is moved along the inclined surface of the first end face 67 toward the second projection 65B against the urging force of the urging member (not shown) applied to the actuator 82, so that the main electrode 81 is seated on the second projection 65B to provide the retracted position thereof. The ensuring portion 71 immediately upstream of the second projection 65B in the counterclockwise direction in a right side view is provided to prevent the main electrode 81 from being moved to the advanced position even if the left end portion of the main electrode 81 which has been seated on the second projection 65B is unintentionally moved past the second projection 65B. That is, by virtue of the ensuring portion 71, the retracted position of the main electrode 81 can be ensured.

Simultaneously, the actuator 82 is pivotally moved in the counterclockwise direction in a plan view against the urging force of the urging member, so that the actuator 82 is moved to the light shielding position from the light transmitting position.

Thus, output of the ON signal from the photo-sensor 83 to the CPU 84 is interrupted. That is, the detection unit (the actuator 82 and the photo-sensor 83) detects the retracted position of the main electrode 81. Due to the interruption of the ON signal from the photo-sensor 83, the CPU 84 determines that the main electrode 81 has been moved to the retracted position from the advanced position.

In accordance with further rotation of the cartridge electrode 52 in the counterclockwise direction in a right side view, as shown in FIG. 7B, the teeth lacking portion 70 of the chipped gear 64 of the cartridge electrode 52 is brought into confrontation with the agitator gear 45, releasing meshing engagement between the toothed portion 69 and the agitator gear 45. Thus, rotation of the cartridge electrode 52 is stopped to terminate the warm-up operation.

Further, upon supply of developing bias from the power source in the main casing 2 to the cartridge electrode 52 through the main electrode 81, the developing bias is supplied to the developing roller shaft 30 through the bearing member 51.

The CPU 84 determines that the developing cartridge 25 is a new (unused) cartridge based on the detection of movement of the main electrode 81 from the retracted position to the advanced position and then from the advanced position to the retracted position after starting the warm-up operation.

After the determination, the CPU 84 counts printing times, and notifies and displays on an operation panel (not shown) an exchanging timing of the developing cartridge 25 when the counted printing times approaches a predetermined printing times (for example, 6000 sheets printing).

Incidentally, the CPU 84 determines assembly of the developing cartridge 25 into the main casing 2 when the ON signal from the photo-sensor 83 is interrupted within a predetermined time period (that is, when the main electrode 81 is judged to be at the retracted position).

On the other hand, there is a case where after the new developing cartridge 25 is assembled, the developing cartridge 25 is again assembled into the main casing 2 after the cartridge 25 is detached from the main casing 2, for example, for removing a jammed sheet S. In such a case, rotation of the cartridge electrode 52 is stopped while the teeth lacking portion 70 of the chipped gear 64 confronts the agitator gear 45.

Therefore, in the re-assembly, rotation of the cartridge electrode 52 is not started even after the warm-up operation, and as a result, the new cartridge detection will not be carried out. In the latter case, because the main electrode 81 stays at the retracted position, the CPU 84 does not receive an ON signal from the photo-sensor 83. Thus, the CPU 84 determines that the main electrode 81 is at the retracted position.

Accordingly, the CPU 84 determines that the developing cartridge 25 has been assembled into the main casing 2. Further the CPU 84 determines that the re-assembled cartridge 25 is an old cartridge 25. Then, the CPU 84 continues comparison between the predetermined printing times and the accumulated total number of printing times from the timing at which the CPU 84 determines that the assembled developing cartridge 25 is a new cartridge.

5. Operations and Effects (1) According to the above-described printer 1, movement (rotational movement) of the cartridge electrode 52 permits the main electrode 81 electrically connected thereto to be moved to the advanced position shown in FIG. 7A and to the retracted position shown in FIG. 7B, and conditions of the developing cartridge 25 (whether or not the developing cartridge 25 is a new cartridge) can be determined based on the movement of the main electrode 81.

Accordingly, both power supply to the developing cartridge 25 and detection of the conditions of the developing cartridge 25 can be performed as long as positioning accuracy between the cartridge electrode 52 and the main electrode 81 is stabilized. Thus, accurate detection with respect to the conditions of the developing cartridge 25 can be performed.

(2) Further, the cartridge electrode 52 has the projections 65 and the recessed portion 66 recessed leftward from the projections 65 as shown in FIG. 5A. Therefore, movement of the main electrode 81 in the lateral direction can be performed with a simple construction.

(3) Further, as shown in FIGS. 5A and 7A, the main electrode 81 can be moved leftward from the retracted position to the advanced position while the main electrode 81 is moved along the second end face 68 of the recessed portion 66. Further, the main electrode 81 can be moved rightward from the advanced position to the retracted position while the main electrode 81 is moved along the first end face 67 of the recessed portion 66 as shown in FIGS. 5A and 7B. Therefore, the main electrode 81 can be smoothly moved in the lateral direction.

(4) Further, as shown in FIG. 5B, the cartridge electrode 52 has the chipped gear 64 provided with the toothed portion 69 and the teeth lacking portion 70. Therefore, stabilized angular rotational movement of the cartridge electrode 52 can be provided.

Figure 6A:
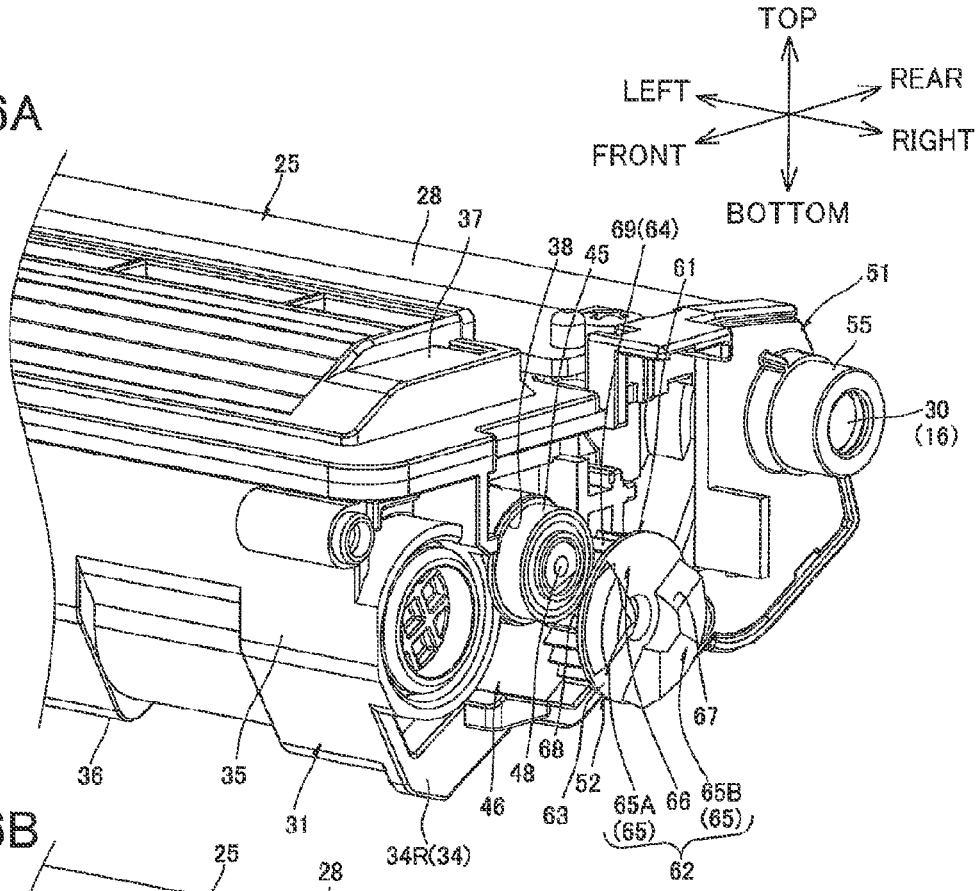
Figure 6B:
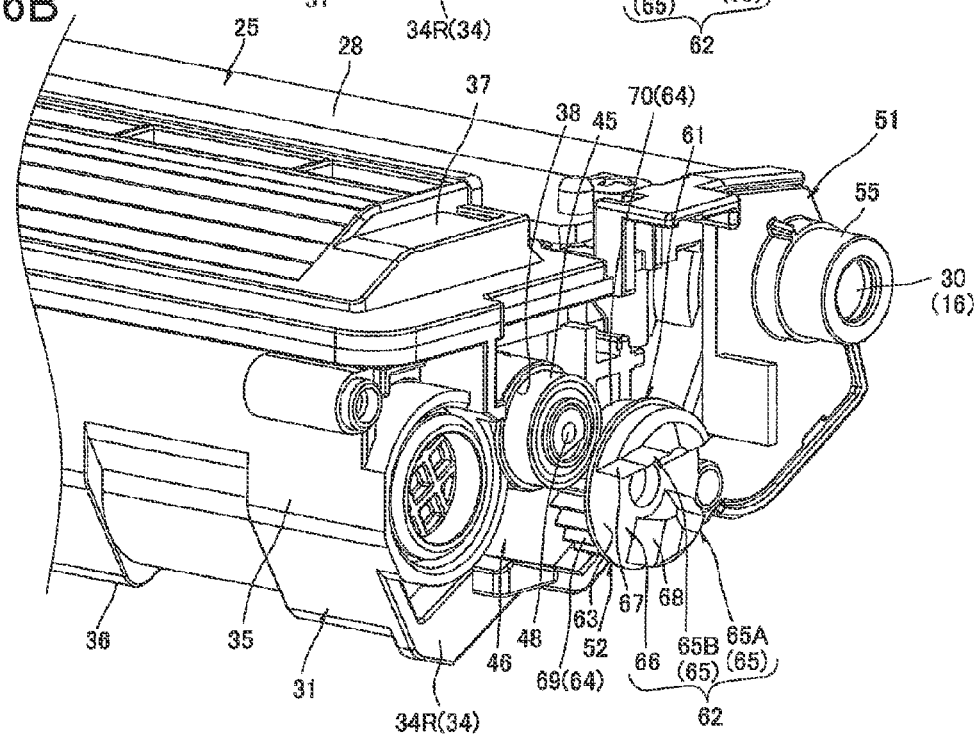

(5) Further, as shown in FIGS. 6A and 6B, the cartridge electrode 52 is rotatably provided. Therefore, the main electrode 81 can be moved stably with the simple construction.

(6) Further, existence or non-existence of the developing cartridge 25 in the main casing 2 can be detected by detecting the position of the main electrode 81.

(7) Further, as shown in FIGS. 7A and 7B, according to the developing cartridge 25, angular displacement of the projections 65 and the recessed portion 66 caused by angular rotation of the cartridge electrode 52 is detected by external components such as the main electrode 81, the actuator 82 and the photo-sensor 83. That is, the component of the developing cartridge 25, i.e., the cartridge electrode 52, can be used for detecting a new cartridge or an old cartridge. Accordingly, no additional component is required for the detection, simplifying construction of the developing cartridge 25.

6. Second Embodiment

A developing cartridge 125 according to a second embodiment of the present invention will next be described with reference to FIGS. 8A to 9 wherein like parts and components are designated by the same reference numerals as those shown in the first embodiment (FIGS. 1 through 7B) to avoid duplicating description.

According to the first embodiment, the cartridge electrode 52 is in the form of generally disc shape, and is rotatable in the counterclockwise direction in a right side view. In contrast, according to the second embodiment, a cartridge electrode 96 is generally flat rectangular plate shaped, and is slidably and linearly movable in the frontward/rearward direction.

Further, according to the first embodiment, the CPU 84 determines that the assembled developing cartridge 25 is a new cartridge as a result of judgment that the main electrode 81 is moved from the retracted position to the advanced position, and then moved from the advanced position to the retracted position after starting the warm-up operation of the developing cartridge 25.

On the other hand, according to the second embodiment, the CPU 84 determines that the assembled developing cartridge 125 is a new cartridge as a result of judgment that the main electrode 81 is moved from the advanced position to the retracted position after starting the warm-up operation of the developing cartridge 125.

More specifically, a power supply unit 133 includes the cartridge electrode 96, a support rail 97, and a pinion gear 98. The support rail 97 is adapted to slidably support the cartridge electrode 96 in the frontward/rearward direction. The pinion gear 98 is adapted to input a driving force to the cartridge electrode 96.

The cartridge electrode 96 is generally U-shaped in a side view with its front end being open, and includes a displacement portion 99, and a rack portion 100. The displacement portion 99 is generally rectangular plate shaped in a side view, and has a front end portion formed into a slant surface where the surface is directed diagonally rightward and rearward.

The rack portion 100 is generally beam shaped extending frontward from a front lower end portion of the displacement portion 99. A front half portion of the rack portion 100 is provided with a toothed portion 91 at its upper surface, and a rear half portion of the rack portion 100 is a toothless portion 92. Incidentally, the rack portion 100 is positioned rightward of and in abutment with a right end portion of the support boss 57 of the bearing member 51.

The support rail 97 includes a pair of rail portions 95 confronting with each other and spaced away from each other in the vertical direction for slidably supporting upper and lower end portions of the cartridge electrode 96 such that an upper rail portion 95 is positioned above the upper end portion of the cartridge electrode 96 and a lower rail portion 95 is positioned below the lower end portion of the cartridge electrode 96.

The pinion gear 98 is fixed to the right end portion of the agitator shaft 48 at a position between the rail portions 95, 95, and is meshingly engageable with the front end portion of the toothed portion 91 of the rack portion 100 from above.

When the process cartridge 11 (the developing cartridge 125) is not assembled to the main casing 2, similar to the first embodiment, the actuator 82 is positioned at the light transmitting position by the urging force of the urging member (not shown), so that the main electrode 81 is positioned at the advanced position. Thus, the photo-sensor 83 outputs an ON signal to the CPU 84.

Then, if this state continues for a predetermined time period (if the advanced position of the main electrode 81 is maintained for the predetermined time period), in other words, if the ON signal from the photo-sensor 83 is not interrupted within the predetermined time period, the CPU 84 determines that the developing cartridge 25 is not assembled to the main casing 2.

When a new developing cartridge 125 (being not in use) is assembled into the main casing 2, the main coupling (not shown) in the main casing 2 is fitted with the developing coupling (not shown) of the drive unit 32, preventing relative rotation therebetween, to start the warm-up operation.

Incidentally, when the new developing cartridge 125 is assembled into the main casing 2, the main electrode 81 is positioned at the advanced position at a front side of the displacement portion 99.

After starting the warm-up operation, a driving force from the developing coupling (not shown) is transmitted to the agitator shaft 48 through the gear train (not shown) to rotate the agitator 47.

Upon rotation of the agitator 47, a driving force from the agitator shaft 48 is transmitted to the rack portion 100 of the cartridge electrode 96 through the pinion gear 98, so that the cartridge electrode 96 is linearly slidingly moved frontward.

As a result, the left end portion of the main electrode 81 is seated on the right side surface of the displacement portion 99 after moving along the slant surface of the displacement portion 99. When the toothless portion 92 of the rack portion 100 is brought into confrontation with the pinion gear 98, meshing engagement between the rack portion 100 and the pinion gear 98 is released to stop sliding movement of the cartridge electrode 96. Thus, the warm-up operation is terminated.

Consequently, the main electrode 81 is moved rightward to the retracted position from the advanced position against the urging force of the urging member (not shown) applied to the actuator 82.

Simultaneously, the actuator 82 is moved in the counterclockwise direction in a plan view from the light transmitting position to the light shielding position against the urging force of the urging member.

Thus, output of the ON signal from the photo-sensor 83 to the CPU 84 is interrupted. In other words, the detection unit (the actuator 82 and the photo-sensor 83) detects the retracted position of the main electrode 81. Then, the CPU 84 determines that the main electrode 81 has been moved from the advanced position to the retracted position due to interruption of the ON signal from the photo-sensor 83.

The CPU 84 determines that the developing cartridge 125 is a new (unused) cartridge based on the detection of movement of the main electrode 81 from the advanced position to the retracted position after starting the warm-up operation.

Incidentally, the CPU 84 determines assembly of the developing cartridge 25 into the main casing 2 when the ON signal form the photo-sensor 83 is interrupted within a predetermined time period (that is, when the main electrode 81 is judged to be at the retracted position).

Figure 8A:
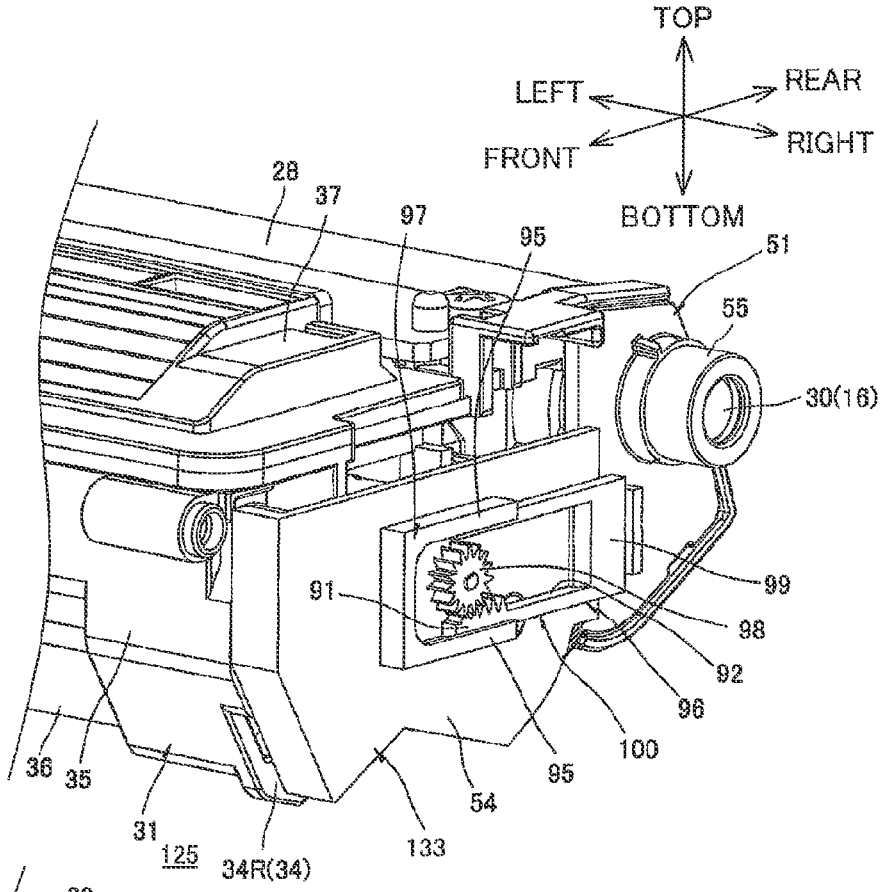
Figure 8B:
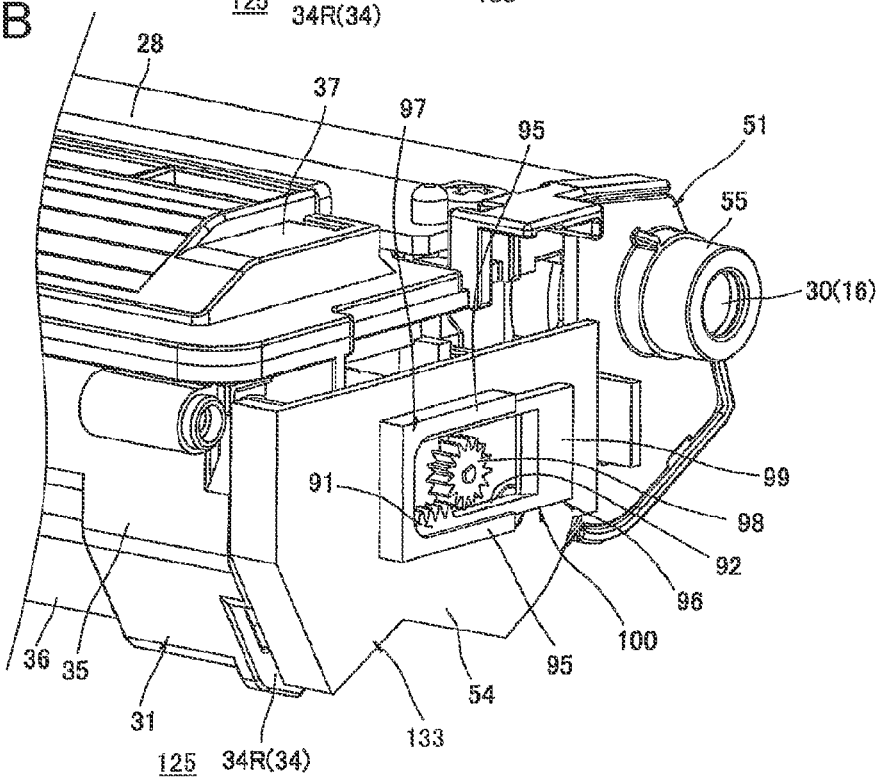
Figure 9:
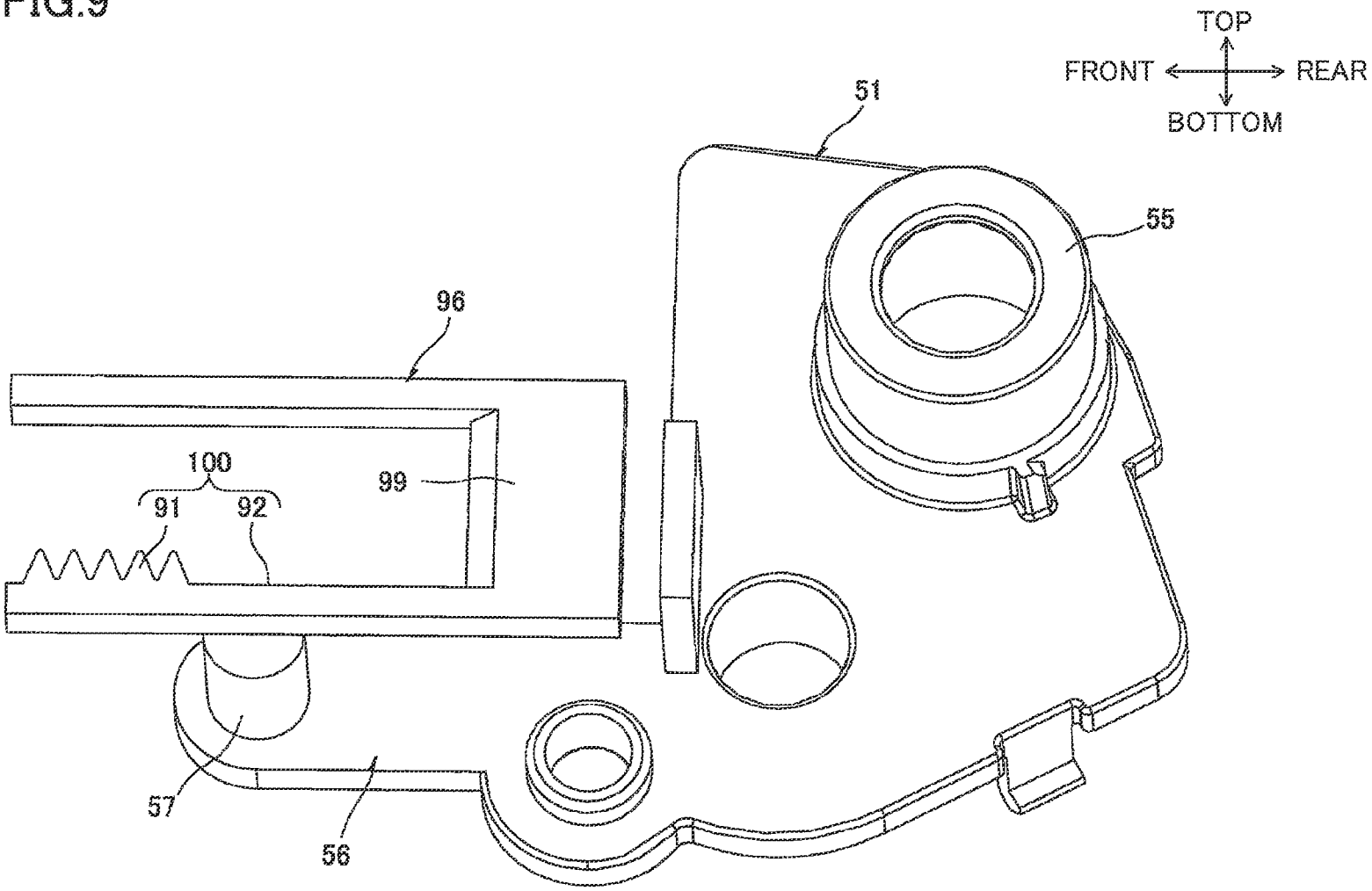
FIG. 9 is a perspective view particularly showing positional relationship between a bearing member and the cartridge electrode which are components of the developing cartridge according to the second embodiment.

According to the second embodiment, as shown in FIG. 8A, the cartridge electrode 96 is linearly slidingly movable frontward. Simple linear sliding movement of the cartridge electrode 96 can permit the main electrode 81 to be moved. In other words, movement of the main electrode 81 can be realized with a simple construction.

Further, according to the second embodiment, operations and effects similar to those of the first embodiment can also be obtained.

7. Third Embodiment

A developing cartridge 225 according to a third embodiment of the present invention will next be described with reference to FIGS. 10A through 11C wherein like parts and components are designated by the same reference numerals as those shown in the first embodiment (FIGS. 1 through 7B) to avoid duplicating description.

According to the first embodiment, the cartridge electrode 52 has two projections 65, and the single recessed portion 66 is defined between the two projections 65. Further, the main electrode 81 is slidably movable in the lateral direction between the advanced position shown in FIG. 7A where the main electrode 81 is advanced leftward and the retracted position shown in FIG. 7B where the main electrode 81 is retracted rightward. Further, the actuator 82 is pivotally movable between the light transmitting position as shown in FIG. 7A where the abutment lever 86 extends diagonally frontward and leftward and the light shielding lever 87 extends diagonally rearward and rightward and the light shielding position as shown in FIG. 7B where the abutment lever 86 and the light shielding lever 87 are directed in the frontward/rearward direction. Further, the CPU 84 determines that the developing cartridge 25 is the new cartridge as a result of determination that the main electrode 81 is moved from the retracted position to the advanced position and then moved from the advanced position to the retracted position after starting the warm-up operation of the developing cartridge 25.

Figure 10A:
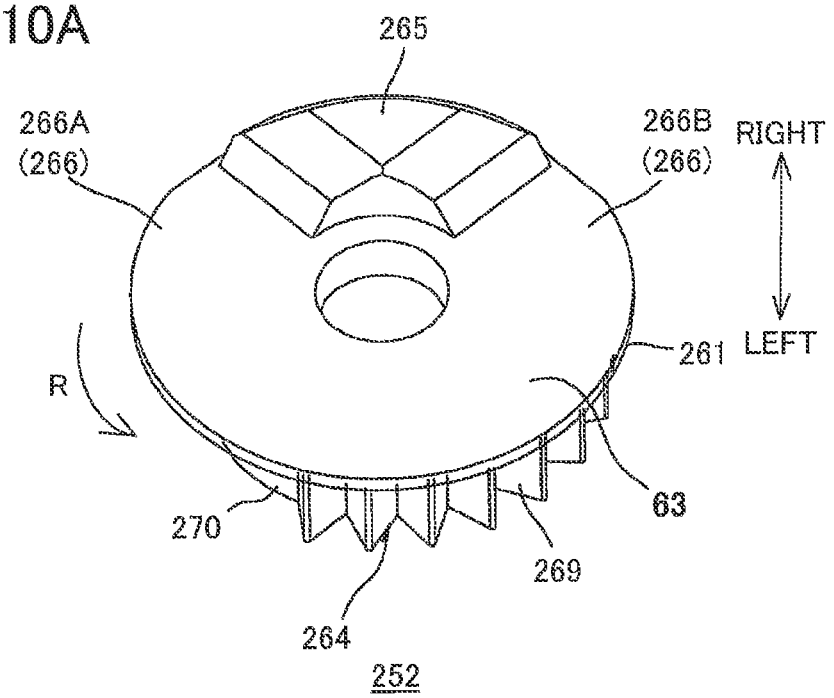
Figure 10B:
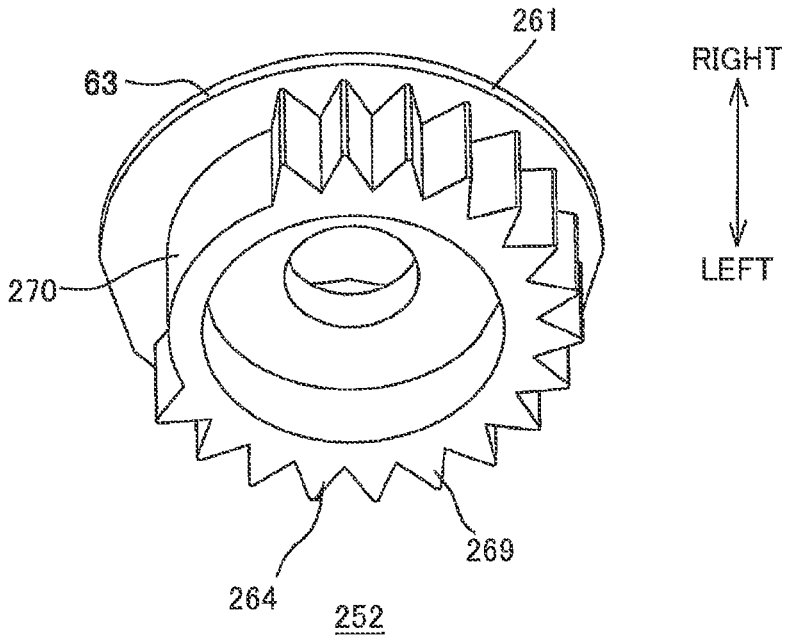

In contrast, according to the third embodiment, as shown in FIG. 10A, a cartridge electrode 252 has a single projection 265. A recessed portion 266 is positioned beside a downstream side and an upstream side of the projection 265 in the counterclockwise direction in a right side view. The recessed portion 266 positioned at the downstream side of the projection 265 in the counterclockwise direction in a right side view will be referred to as a first recessed region 266A, and the recessed portion 266 positioned at the upstream side of the projection 265 in the counterclockwise direction in a right side view will be referred to as a second recessed region 266B. Further, the cartridge electrode 252 includes a chipped gear 264 provided with a toothed portion 269 and a toothless portion 270, as shown in FIG. 10B. The toothed portion 269 has a center angle of 270 degrees. The toothless portion 270 is defined other than the toothed portion 269 and positioned below a portion of the first recessed region 266A.

Figure 11A:
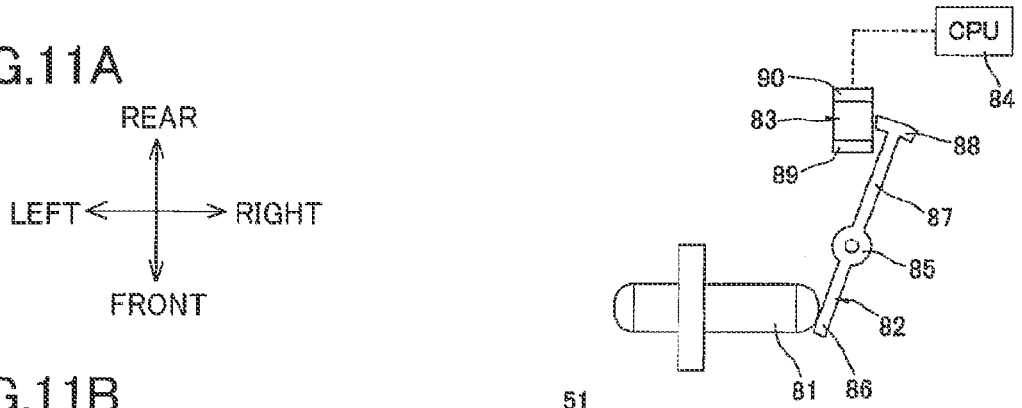
Figure 11B:
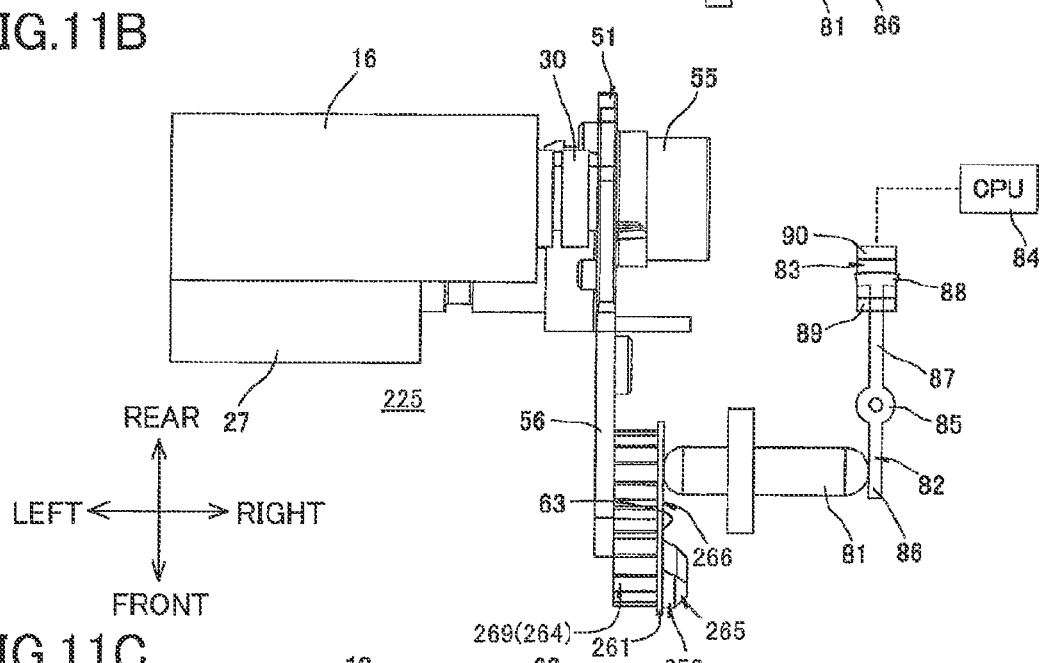
Figure 11C:
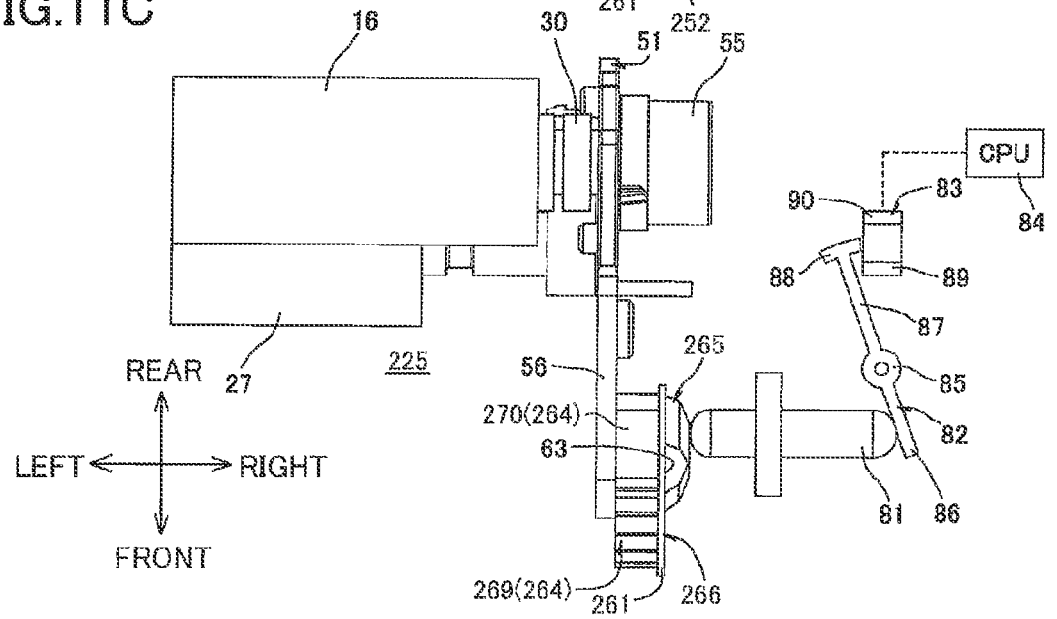
Figures 12A, 12B:
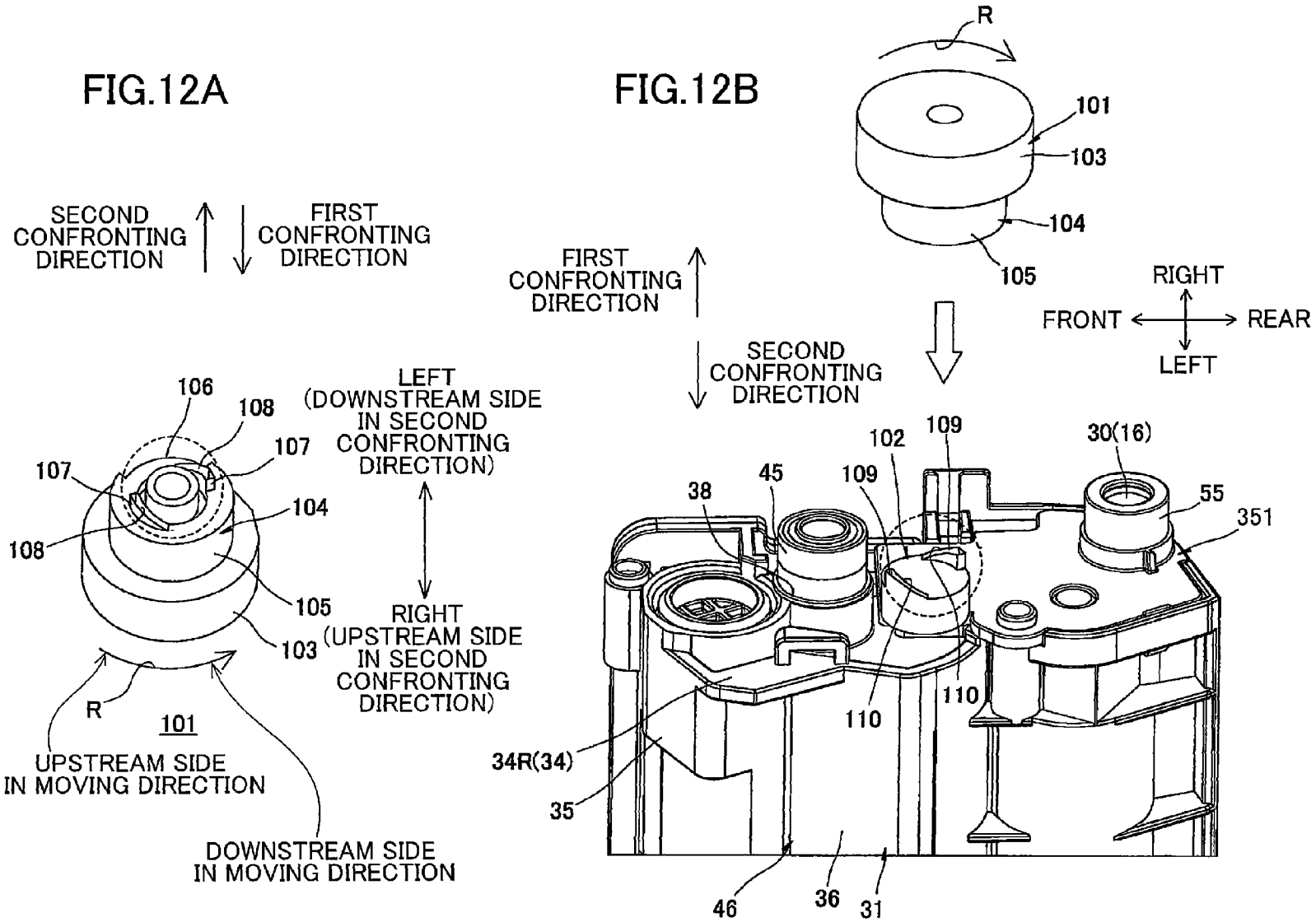

Further, the main electrode 81 is slidably movable in the lateral direction to one of a reference position as shown in FIG. 11B, an advanced position as shown in FIG. 11A, and a retracted position as shown in FIG. 11C. In the reference position, the main electrode 81 is in contact with the cartridge electrode 252 during an image forming operation in the printer 1. In the advanced position, the main electrode 81 is advanced leftward from the reference position. In the retracted position, the main electrode 81 is retracted rightward from the reference position.

Further, the actuator 82 is pivotally movable to one of a first light transmitting position shown in FIG. 11A, a light shielding position shown in FIG. 11B, and a second light transmitting position shown in FIG. 11C. In the first light transmitting position, the abutment lever 86 extends diagonally frontward and leftward while the light shielding lever 87 extends diagonally rearward and rightward. In the light shielding position, the abutment lever 86 and the light shielding lever 87 extend in the frontward/rearward direction. In the second light transmitting position, the abutment lever 86 extends diagonally frontward and rightward while the light shielding lever 87 extends diagonally rearward and leftward. The actuator 82 is normally urged in a clockwise direction in a plan view toward the first light transmitting position by an urging member (not shown), such as a spring.

When the process cartridge 11 (the developing cartridge 225) is not assembled to the main casing 2, the actuator 82 is positioned at the first light transmitting position shown in FIG. 11A by the urging force of the urging member, so that the main electrode 81 is positioned at the advanced position. In this state, the photo-sensor 83 transmits an ON signal to the CPU 84.

If a predetermined time period has been elapsed while maintaining the advanced position of the main electrode 81, that is, if the ON signal from the photo-sensor 83 is not interrupted within the predetermined time period, the CPU 84 determines that the developing cartridge 225 is not assembled to the main casing 2.

Figures 1, 10C:
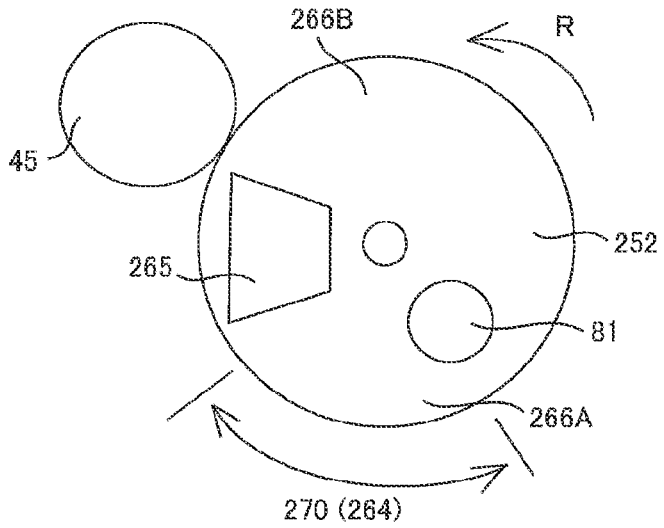
Figures 2, 10C:
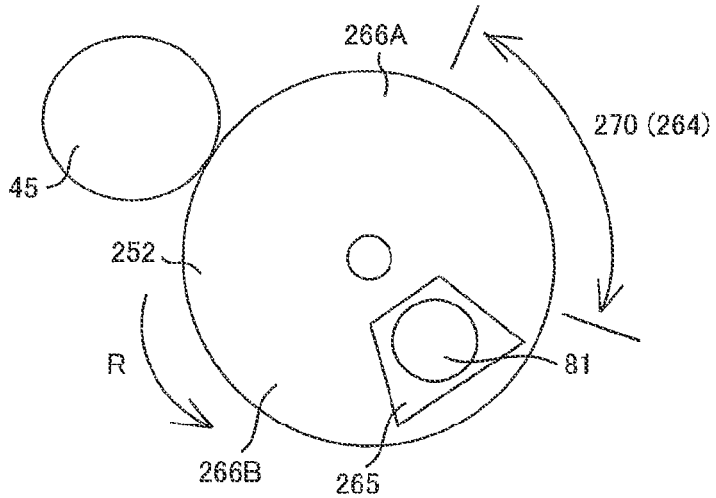
Figures 3, 10C:
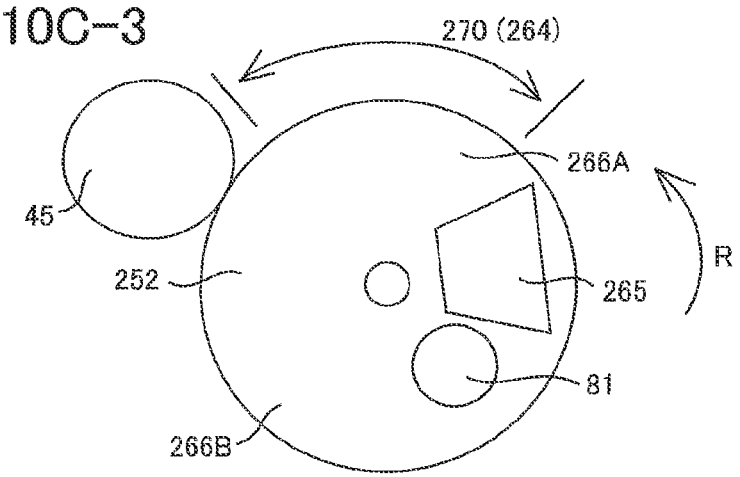

When a new developing cartridge 225 is assembled into the main casing 2, the left end portion of the main electrode 81 is in contact with a part of a base portion 261, the part being located downstream of the projection 265 in the counterclockwise direction in a right side view. That is, when a new developing cartridge 225 is assembled into the main casing 2, the left end portion of the main electrode 81 is in contact with the first recessed region 266A, as shown in FIG. 10C-1.

As a result, the main electrode 81 is urged rightward against the urging force of the urging member applied to the actuator 82 from the advanced position to the reference position while the actuator 82 is pivotally moved in the counterclockwise direction in a plan view from the first light transmitting position to the light shielding position.

Thus, output of the ON signal from the photo-sensor 83 to the CPU 84 is interrupted. In other words, the detection unit (the actuator 82 and the photo-sensor 83) detects the reference position of the main electrode 81. Then, the CPU 84 determines that the main electrode 81 has been moved from the advanced position to the reference position due to interruption of the ON signal from the photo-sensor 83 prior to the warm-up operation.

After the developing cartridge 225 is assembled into the main casing 2, the warm-up operation is started, so that the cartridge electrode 252 is rotated in the counterclockwise direction in a right side view.

Then, the main electrode 81 is relatively moved in the clockwise direction in a right side view from the first recessed region 266A located downstream of the projection 265 in the counterclockwise direction in a right side view, so that the main electrode 81 which has been seated on the first recessed region 266A is seated onto the projection 265 against the urging force of the urging member (not shown) applied to the actuator 82 to provide the retracted position thereof, as shown in FIG. 10C-2.

At the same time, the actuator 82 is pivotally moved in the counterclockwise direction in a plan view from the light shielding position to the second light transmitting position as shown in FIG. 11C against the urging force of the urging member (not shown).

Thus, the photo-sensor 83 outputs the ON signal to the CPU 84. In other words, the detection unit (the actuator 82 and the photo-sensor 83) detects the retracted position of the main electrode 81.

Then, the CPU 84 determines that the main electrode 81 has been moved from the reference position to the retracted position upon receipt of the ON signal from the photo-sensor 83 after starting the warm-up operation.

As a result of further rotation of the cartridge electrode 252 in the counterclockwise direction in a right side view, the main electrode 81 is relatively moved in the clockwise direction in a right side view from the projection 265, so that the main electrode 81 is brought into confrontation with the second recessed region 266B located upstream of the projection 265 in the counterclockwise direction in a right side view, as shown in FIG. 10C-3.

Then, the main electrode 81 is moved leftward from the retracted position to the reference position by the urging force of the urging member (not shown) applied to the actuator 82.

At the same time, the actuator 82 is pivotally moved in the clockwise direction in a plan view from the second light transmitting position to the light shielding position by the urging force of the urging member (not shown).

Thus, output of the ON signal from the photo-sensor 83 to the CPU 84 is interrupted. That is, the detection unit (the actuator 82 and the photo-sensor 83) detects the reference position of the main electrode 81. Then, the CPU 84 determines that the main electrode 81 has been moved from the retracted position to the reference position due to interruption of the ON signal from the photo-sensor 83.

In accordance with further rotation of the cartridge electrode 252 in the counterclockwise direction in a right side view, the toothless portion 270 of the chipped gear 264 of the cartridge electrode 252 is brought into confrontation with the agitator gear 45, releasing meshing engagement between the toothed portion 269 of the chipped gear 264 and the agitator gear 45. Thus, rotation of the cartridge electrode 252 is stopped to terminate the warm-up operation.

The CPU 84 determines that the developing cartridge 225 is a new (unused) cartridge based on the detection of movement of the main electrode 81 from the reference position to the retracted position and then from the retracted position to the reference position after starting the warm-up operation.

Incidentally, the CPU 84 determines assembly of the developing cartridge 225 into the main casing 2 when the ON signal from the photo-sensor 83 is interrupted within the predetermined time period (that is, when the main electrode 81 is judged to be at the reference position).

According to the third embodiment, operations and effects similar to those of the first embodiment can also be obtained.

8. Fourth Embodiment

A developing cartridge 325 according to a fourth embodiment of the present invention will next be described with reference to FIGS. 12A to 13B wherein like parts and components are designated by the same reference numerals as those shown in the first and third embodiments (FIGS. 1 through 7B, 10A through 11C) to avoid duplicating description.

In the first embodiment, the cartridge electrode 52 is rotatably supported to the support boss 57 of the bearing member 51. Further, the cartridge electrode 52 is rotatable in the counterclockwise direction in a right side view while the agitator gear 45 rotates in the clockwise direction in a right side view.

On the other hand, according to the fourth embodiment, a cartridge electrode 101 is rotatably supported to a support boss 102 of a bearing member 351, and is rotatable in the clockwise direction in a right side view while the agitator gear 45 rotates in the counterclockwise direction in a right side view and is movable in the lateral direction relative to the support boss 102.

More specifically, the cartridge electrode 101 is made from an electrically conductive resin and integrally includes an electrode body 103 configured to be contacted with the main electrode 81, and a chipped gear 104.

The electrode body 103 is generally cylindrical extending in the lateral direction, and has a flat right side surface.

The chipped gear 104 is generally cylindrical and extends leftward from the electrode body 103 coaxially therewith. The chipped gear 104 has an outer peripheral surface provided with a teethed portion 105 whose center angle is approximately 270 degrees. A toothless portion 106 is defined at the outer peripheral surface and other than the teethed portion 105. The chipped gear 104 has two displacement portions 107.

Each displacement portion 107 protrudes leftward from a left side surface of the chipped gear 104, and extends in an arcuate fashion whose center of radius of curvature is at an axial center of the chipped gear 104. The two displacement portions 107 are spaced away from each other at diametrically opposite sides. Each displacement portion 107 has a left side surface 108 which is inclined leftward toward an upstream side in a rotational direction R of the cartridge electrode 101. The left side surface 108 functions. The rotational direction R is the clockwise direction in a right side view.

The support boss 102 is positioned at a front end portion of the bearing member 351, and protrudes rightward from a right side surface thereof. The support boss 102 is generally cylindrical shaped and has displacement portions 109.

Each displacement portion 109 protrudes rightward from a right side surface of the support boss 102, and extends in an arcuate fashion whose center of radius of curvature is at an axial center of the support boss 102. The two displacement portions 109 are spaced away from each other at diametrically opposite sides. Each displacement portion 109 has a right side surface 110 which is inclined rightward toward a downstream side in the rotational direction R of the cartridge electrode 101.

The cartridge electrode 101 is coaxial with the support boss 102, and is rotatably supported to a right end portion of the support boss 102 such that each upstream end portion of each displacement portion 107 of the cartridge electrode 101 is in abutment with each upstream end portion of each displacement portion 109 of the support boss 102.

The cartridge electrode 101 is rotatable in the rotational direction R such that the displacement portions 107 slide with respect to the displacement portions 109. By the rotation, the cartridge electrode 101 is movable between a first position as shown in FIG. 13B displaced rightward and a second position as shown in FIG. 13A displaced leftward.

Figure 13A:
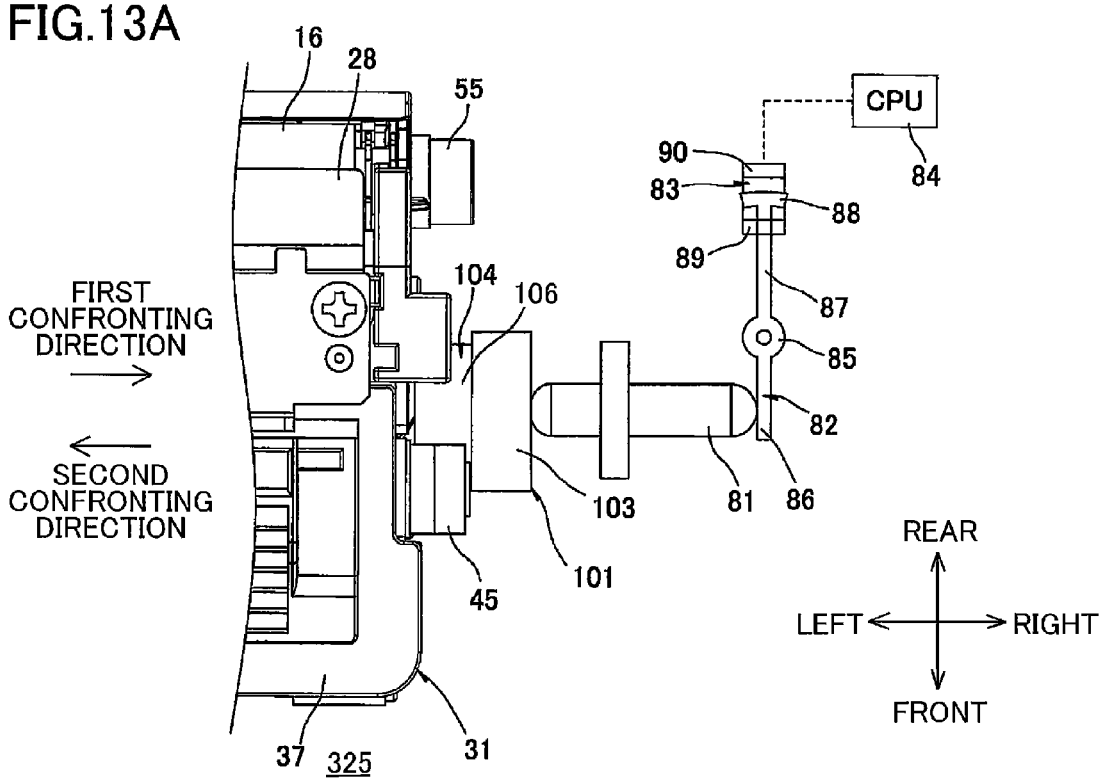
Figure 13B:
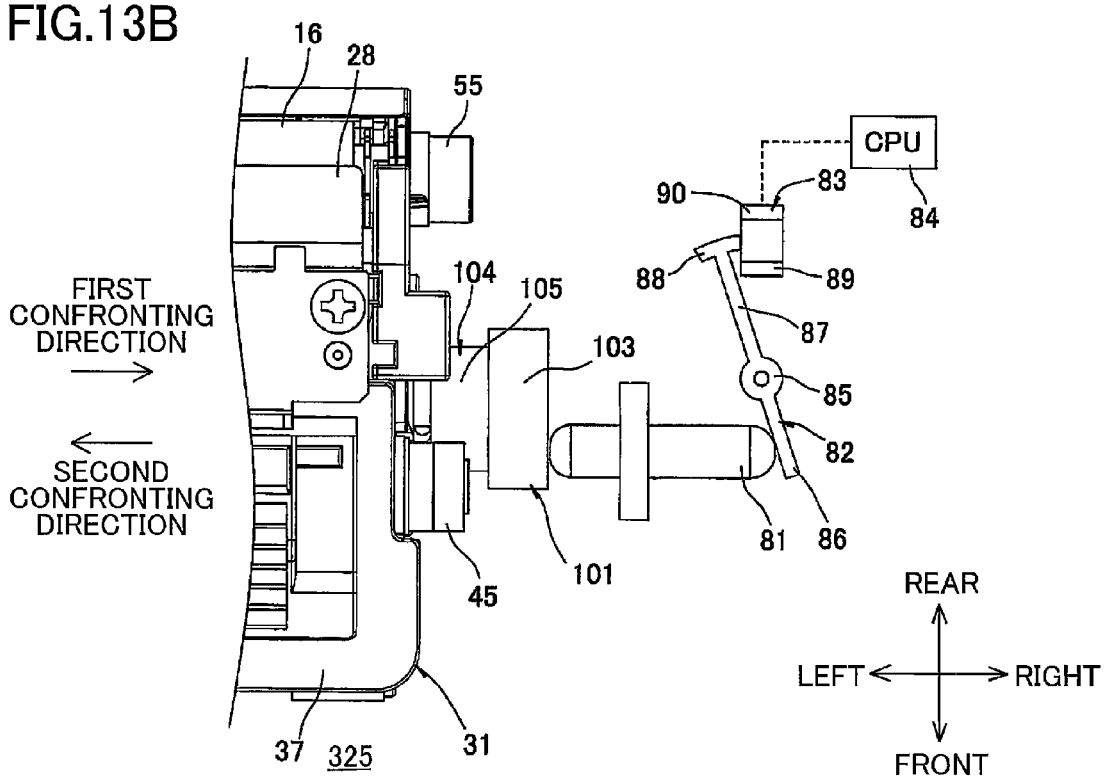

Similar to the third embodiment, the main electrode 81 is linearly movable in the lateral direction to one of an advanced position (not shown but similar to FIG. 11A), a reference position as shown in FIG. 13A, and a retracted position as shown in FIG. 13B. When the process cartridge 11 (the developing cartridge 325) is not assembled to the main casing 2, the actuator 82 is positioned at a first light transmitting position (not shown but similar to FIG. 11A) by the urging force of the urging member (not shown). Thus, the main electrode 81 is positioned at the advanced position. In this state, the photo-sensor 83 outputs an ON signal to the CPU 84.

If a predetermined time period has been elapsed while maintaining the advanced position of the main electrode 81, that is, if the ON signal from the photo-sensor 83 is not interrupted within the predetermined time period, the CPU 84 determines that the developing cartridge 325 is not assembled to the main casing 2.

When a new developing cartridge 325 is assembled, the left end portion of the main electrode 81 is in contact with the electrode body 103 of the cartridge electrode 101.

As a result, the main electrode 81 is urged rightward against the urging force of the urging member applied to the actuator 82 from the advanced position to the reference position, while the actuator 82 is pivotally moved in the counterclockwise direction in a plan view from the first light transmitting position to the light shielding position, as shown in FIG. 13A.

Thus, output of the ON signal from the photo-sensor 83 to the CPU 84 is interrupted. In other words, the detection unit (the actuator 82 and the photo-sensor 83) detects the reference position of the main electrode 81. Then, the CPU 84 determines that the main electrode 81 has been moved from the advanced position to the reference position due to interruption of the ON signal from the photo-sensor 83 prior to the warm-up operation.

After the developing cartridge 325 is assembled into the main casing 2, the warm-up operation is started, so that the cartridge electrode 101 is rotated in the clockwise direction in a right side view.

Then, relative sliding movement occurs between the right side surface 110 of each displacement portion 109 of the support boss 102 and the left side surface 108 of each displacement portion 107 of the cartridge electrode 101. Thus, the cartridge electrode 101 is gradually moved rightward to the first position as shown in FIG. 13B in accordance with rotation of the cartridge electrode 101.

At the same time, the main electrode 81 is pushed rightward by the cartridge electrode 101 to the retracted position against the urging force of the urging member (not shown) applied to the actuator 82, and the actuator 82 is pivotally moved in the counterclockwise direction in a plan view from the light shielding position to the second light transmitting position as shown in FIG. 13B against the urging force of the urging member (not shown).

Thus, the photo-sensor 83 outputs the ON signal to the CPU 84. That is, the detection unit (the actuator 82 and the photo-sensor 83) detects that the retracted position of the main electrode 81. Then, the CPU 84 determines that the main electrode 81 has been moved from the reference position to the retracted position upon receipt of the ON signal from the photo-sensor 83 after starting the warm-up operation.

As a result of further rotation of the cartridge electrode 101 in the clockwise direction in a right side view, each displacement portion 107 of the cartridge electrode 101 is positioned downstream of the corresponding displacement portion 109 of the support boss 102 in the rotational direction R. Consequently, the cartridge electrode 101 can be moved leftward.

Thus, the cartridge electrode 101 is pushed leftward to the second position as shown in FIG. 13A through the main electrode 81 by the urging force of the urging member (not shown) applied to the actuator 82.

At the same time, the main electrode 81 is moved leftward from the retracted position to the reference position by the urging force of the urging member (not shown) applied to the actuator 82. Further, the actuator 82 is pivotally moved in the clockwise direction in a plan view from the second light transmitting position to the light shielding position by the urging force of the urging member (not shown).

Thus, output of the ON signal from the photo-sensor 83 to the CPU 84 is interrupted. That is, the detection unit (the actuator 82 and the photo-sensor 83) detects the reference position of the main electrode 81. Then, the CPU 84 determines that the main electrode 81 has been moved from the retracted position to the reference position due to interruption of the ON signal from the photo-sensor 83.

In accordance with further rotation of the cartridge electrode 101 in the clockwise direction in a right side view, the toothless portion 106 of the cartridge electrode 101 is brought into confrontation with the agitator gear 45, releasing meshing engagement between the teethed portion 105 of the chipped gear 104 and the agitator gear 45. Thus, rotation of the cartridge electrode 101 is stopped to terminate the warm-up operation.

The CPU 84 determines that the developing cartridge 25 is a new (unused) cartridge based on the detection of movement of the main electrode 81 from the reference position to the retracted position and then from the retracted position to the reference position after starting the warm-up operation.

Incidentally, the CPU 84 determines assembly of the developing cartridge 25 into the main casing 2 when the ON signal from the photo-sensor 83 is interrupted within the predetermined time period (that is, the main electrode 81 is judged to be at the reference position).

According to the fourth embodiment, the cartridge electrode 101 is movable to the first position displaced rightward shown in FIG. 13B and to the second position displaced leftward shown in FIG. 13A. Therefore, the main electrode 81 can be moved in the lateral direction with a simple construction.

Further, as shown in FIG. 13B, the cartridge electrode 101 can be moved rightward from the second position to the first position by relative sliding movement between the left side surface 108 of the displacement portion 107 of the cartridge electrode 101 and the right side surface 110 of the displacement portion 109 of the support boss 102. Therefore, smooth lateral movement of the cartridge electrode 101 can be provided.

Further, according to the fourth embodiment, operations and effects similar to those of the third embodiment can also be obtained.

While the present invention has been described in detail with reference to the embodiments thereof, it would be apparent to those skilled in the art that various changes and modifications may be made therein without departing from the spirit of the present invention.

What is claimed is:

1. A cartridge comprising:

a cartridge frame configured to accommodate developing agent therein, the cartridge frame including a first side wall and a second side wall spaced away from the first side wall and in confrontation with the first side wall in a confronting direction, the confronting direction including a first confronting direction and a second confronting direction opposite to the first confronting direction;

a drive input portion provided at one of the first side wall and the second side wall and configured to receive an external driving force; and a cartridge electrode provided at the second side wall and configured to be moved in a moving direction by a predetermined moving amount in response to the external driving force being received by the cartridge electrode as a result of an input of the external driving force to the drive input portion, the cartridge electrode being further configured to receive external electric power, the cartridge electrode including a first region and a second region, the first region being a projection, the second region being a recessed portion, the cartridge electrode having one side surface at a downstream side thereof in the first confronting direction, the projection protruding in the first confronting direction from the one side surface while defining the recessed portion recessed in the second confronting direction, the recessed portion defining a first inclined surface and a second inclined surface, the first inclined surface being inclined in the first confronting direction toward an upstream side in the moving direction of the cartridge electrode, and the second inclined surface being inclined in the second confronting direction toward the upstream side.

2. The cartridge as claimed in claim 1, wherein the cartridge electrode is provided with a partially toothless gear comprising a toothed portion to which a driving force from the drive input portion is transmittable, and a toothless portion prohibiting transmission of the driving force.

3. The cartridge as claimed in claim 2, wherein the cartridge electrode is rotatable in a rotating direction, the moving direction of the cartridge electrode being the rotating direction.

4. The cartridge as claimed in claim 1, wherein the cartridge frame has a developing agent accommodating portion configured to accommodate developing agent therein, the developing agent accommodating portion being disposed between the first side wall and the second side wall in the confronting direction;

wherein the drive input portion is disposed at a position opposite to the developing agent accommodating portion with respect to the one of the first side wall and the second side wall; and wherein the cartridge electrode is disposed at a position opposite to the developing agent accommodating portion with respect to the second side wall.

5. A cartridge comprising:

a cartridge frame configured to accommodate developing agent therein, the cartridge frame including a first side wall and a second side wall spaced away from the first side wall and in confrontation with the first side wall in a confronting direction, the confronting direction including a first confronting direction and a second confronting direction opposite to the first confronting direction;

a drive input portion provided at one of the first side wall and the second side wall and configured to receive an external driving force; and a cartridge electrode provided at the second side wall and configured to be moved in a moving direction by a predetermined moving amount in response to the external driving force being received by the cartridge electrode as a result of an input of the external driving force to the drive input portion, the cartridge electrode being further configured to receive external electric power, the cartridge electrode including a first region and a second region, the first region being a projection, the second region being a recessed portion, the cartridge electrode being configured to be advanced to a first position advanced in the first confronting direction and retracted to a second position retracted in the second confronting direction at a time of movement of the cartridge electrode by the predetermined moving amount, the cartridge electrode having one side surface at a downstream side thereof in the second confronting direction, the projection is a projecting portion extending in the moving direction and protruding from the one side surface in the second confronting direction, the projecting portion having a third inclined surface inclined in the second confronting direction toward an upstream side in the moving direction of the cartridge electrode.

6. The cartridge as claimed in claim 5, wherein the cartridge electrode is provided with a partially toothless gear comprising a toothed portion to which a driving force from the drive input portion is transmittable, and a toothless portion prohibiting transmission of the driving force.

7. The cartridge as claimed in claim 6, wherein the cartridge electrode is rotatable in a rotating direction, the moving direction of the cartridge electrode being the rotating direction.

8. The cartridge as claimed in claim 5, wherein the cartridge frame has a developing agent accommodating portion configured to accommodate developing agent therein, the developing agent accommodating portion being disposed between the first side wall and the second side wall in the confronting direction;

wherein the drive input portion is disposed at a position opposite to the developing agent accommodating portion with respect to the one of the first side wall and the second side wall; and wherein the cartridge electrode is disposed at a position opposite to the developing agent accommodating portion with respect to the second side wall.

* * * * *